US005237140A

United States Patent [19]

Akazawa et al.

[11] Patent Number: 5,237,140

[45] Date of Patent: Aug. 17, 1993

[54] A-C/D-C MICROWAVE OVEN

[75] Inventors: Naoki Akazawa; Makoto Gezima, both of Gunma, Japan

[73] Assignee: Sawafuji Electric Co., Ltd., Tokyo, Japan

[21] Appl. No.: 694,813

[22] Filed: May 2, 1991

[30] Foreign Application Priority Data

| | | | |
|---|---|---|---|
| May 25, 1990 | [JP] | Japan | 2-136856 |
| May 30, 1990 | [JP] | Japan | 2-140904 |
| Jun. 14, 1990 | [JP] | Japan | 2-63125[U] |
| Jun. 25, 1990 | [JP] | Japan | 2-66970[U] |
| Jun. 25, 1990 | [JP] | Japan | 2-66971[U] |
| Jul. 11, 1990 | [JP] | Japan | 2-73574[U] |

[51] Int. Cl.[5] ..... H05B 6/66

[52] U.S. Cl. ..... 219/10.55 B; 219/10.55 F; 363/15; 363/19; 323/207

[58] Field of Search ..... 219/10.55 B, 10.55 E, 219/10.55 R; 363/15, 19, 21, 34, 59, 64, 96, 97, 171; 323/207, 215, 247, 251, 319, 359

[56] References Cited

U.S. PATENT DOCUMENTS

| | | | |
|---|---|---|---|
| 3,584,288 | 6/1971 | Boehm | 219/10.55 B |
| 3,665,495 | 5/1972 | Carter et al. | 219/10.55 B |
| 4,777,575 | 10/1988 | Yamato et al. | 219/10.55 B |
| 4,843,202 | 6/1989 | Smith et al. | 219/10.55 B |
| 4,888,461 | 12/1989 | Takano | 219/10.55 B |
| 4,904,837 | 2/1990 | Low et al. | 219/10.55 B |
| 4,928,055 | 5/1990 | Kaieda et al. | 323/300 |

FOREIGN PATENT DOCUMENTS

| | | |
|---|---|---|
| 2701892A1 | 7/1977 | Fed. Rep. of Germany . |
| 3409358C2 | 9/1989 | Fed. Rep. of Germany . |
| 2-129894 | 8/1990 | Japan . |

*Primary Examiner*—Bruce A. Reynolds
*Assistant Examiner*—Tuan Vinh To
*Attorney, Agent, or Firm*—McGlew and Tuttle

[57] ABSTRACT

An a-c/d-c microwave oven adapted to be connected to an a-c and/or d-c power source. The oven has an inverter for converting d-c power to a-c power to feed power to a magnetron generating high-frequency energy via a transformer. Input from the d-c and a-c power sources is selectively fed to the magnetron. A first primary winding is fed commercial a-c power. A second primary winding is fed on a-c voltage from the inverter. A secondary winding connecting to the magnetron is wound on the transformer. A predetermined voltage is adjusted in the secondary winding of the transformer by adjusting the frequency of the a-c voltage from the inverter at a higher level than the commercial a-c power, which is fed to the second primary winding.

6 Claims, 18 Drawing Sheets

A-C/D-C MICROWAVE OVEN

FIELD OF THE INVENTION

This invention relates to an a-c/d-c microwave oven for selectively feeding, via a transformer, either an a-c or d-c power to a magnetron outputting high-frequency energy. The transformer is adapted so that a predetermined voltage is fed to the magnetron with a single transformer from whatever type of power.

BACKGROUND OF THE INVENTION

In recent years, microwave ovens for cooking and other purposes have been widely used not only in mass-catering and other commercial applications but also in household applications. Microwave ovens are also convenient for cooking in pleasure boats or recreational vehicles. For such uses, therefore, a-c/d-c microwave ovens that can power off either a commercial a-c power source or a battery power source are introduced since these pleasure boats or recreational vehicles usually carry batteries having relatively large capacities.

FIG. 1 is a diagram illustrating the basic construction of a microwave oven that can be operated from either of an a-c or d-c power source, on which this invention is based. In the following, the construction shown in FIG. 1 is termed as a prior-art construction for convenience. In the figure, the output of a transformer 2 for a battery power source DC is connected to the secondary side of an existing (that is, built-in) transformer 1 for an a-c power source AC. On an inverter 3 for converting d-c voltage into a-c voltage is provided to feed power to a magnetron 4 outputting high-frequency energy. Symbol S refers to a power changeover switch. That is, the transformer 1 for the a-c power source AC and the transformer 2 for the battery power source DC are separately provided, and when using the a-c power source AC, high voltage is fed to the magnetron 4 via the built-in transformer 1, and when using the battery power source DC, high voltage is similarly fed to the magnetron 4 via the separately provided transformer 2 by changing over the switch S.

Symbol C refers to a capacitor, and D to a diode.

The prior-art construction described above has the following unwanted problems. That is, the fact that the transformer 1 for the a-c power source AC and the transformer 2 for the battery power source DC are separately provided as high-voltage transformers for generating source voltage for the magnetron 4. This tends to increase the space for transformers and the weight of the entire microwave oven unit, leading to increased size and manufacturing cost.

To overcome these problems, a battery-operated converter using the battery power source DC, is provided, as a substitute for the prior-art construction shown in FIG. 1, to produce a-c voltage having the same voltage and frequency as commercial power source. The output of this converter is connected to an existing microwave oven (having a built-in transformer 1). With this construction, however, there arises the need for high-power converter for commercial power source.

To cope with this, an inverter for converting the battery power source DC to a-c voltage is provided. The a-c voltage of the inverter is applied to a primary winding and another primary winding to which commercial power source is applied are wound on a primary side of a single transformer. A common secondary winding is wound on the secondary side of the same transformer. In this case, however, the output voltage produced across the common secondary winding cannot be kept at the same level for both the commercial a-c power and the a-c voltage from the inverter because the frequency of the a-c voltage applied to the primary winding from the inverter is set at the same frequency as that of the commercial a-c power source, and because leakage characteristics requiring the saturated state of approximately 18,000 gauss of magnetic flux have to be provided when feeding the commercial a-c power, whereas leakage characteristics requiring the unsaturated state of approximately 13,000 gauss of magnetic flux have to be provided when feeding the a-c voltage from the inverter.

Assuming that the frequency is f, the number of turns of the common secondary winding is n, the magnetic flux density is B, and the cross-sectional area of the core on which the secondary winding is wound is S, the output voltage E generated in the common secondary winding can be expressed by Equation (1).

$$E=4.44f\cdot n\cdot B\cdot S \qquad (1)$$

Furthermore, since the voltage applied to the magnetron of a microwave oven is determined by the peak value of the output voltage waveform generated in the common secondary winding, the voltage waveform of the square wave from the inverter, as shown in FIG. 2, has to be higher than that of the sine wave of the commercial power source, as shown in FIG. 3, and the number of turns of the primary winding to which the a-c voltage from the inverter is applied has to be reduced. This inevitably increases magnetic flux B, making this construction impractical.

Next, when feeding power to the magnetron 4 using the battery power source DC, as shown in FIG. 1, the battery power source DC may be overdischarged if the load on the magnetron 4 becomes excessive. This poses some hindrance to the subsequent power source, leading to total failure of the DC battery power source. in extreme cases. This is due to the lack of protective means for the battery power source DC. In such a state, if the battery power source DC is used in common with the power source for driving the engine in large pleasure boats or recreational vehicles, failure of the battery power source DC may make subsequent sailing or driving impossible.

In general, the microwave oven has a safety means for preventing magnetic waves from escaping outside the unit even if the door is opened during peration. The microwave oven of the conventional type has a three-stage switching arrangement consisting of switches SW1 through SW3 to prevent the door from being kept opened to protect users from exposure to microwaves, as shown in FIG. 4. The switch SW3 is a monitor switch that opens when the door is closed. In FIG. 4, the commercial power source AC is fed via the closed switches SW1 and SW2, both of which are closed (at this moment, the switch SW3 remains opened), to a transformer 5 where the voltage thereof is boosted up to a high voltage to feed to the magnetron 4 that produces high-frequency energy. Symbol C refers to a capacitor and D to a diode.

With a microwave oven having two a-c power sources of an a-c/d-c power source, such as an example shown in FIG. 5 having a-c power sources AC1 and AC2, the conventional safety means requires a total of six switches SW1 through SW6, as shown in the figure. This means that as many as six switches have to be turned on and off when the door is opened and closed, making the construction of the door quite complex.

In the microwave ovens having two power sources, including the a-c/d-c dual power source, switches installed on the door must be a small-sized microswitch having a small current capacity due to the construction of the door, which precludes the use of large-capacity switches.

Next, it is desired that in the a-c/d-c microwave oven having the above-mentioned construction, a first primary winding that is driven by the a-c power source, a second primary winding that is driven by the battery power source via the inverter, and a secondary winding connected to the magnetron outputting high-frequency energy are wound on a single transformer. In such a case, in order to generate the same voltage (having the same peak value of the output voltage waveform) on the common secondary winding when the a-c power or battery power is supplied to the transformer, it is desired that magnetic fluxes leak appropriately between the first primary winding and the secondary winding. In the a-c/d-c microwave oven of the conventional type, however, no such magnetic circuits are provided, as mentioned above. It is difficult, therefore, to generate the same voltage on the common secondary winding even when the a-c power or the d-c power is supplied to the transformer.

Since a microwave oven having a magnetron that produces high-frequency energy requires large power, utmost care should be exercised not to cause overdischarging when the oven is driven by the battery power source, as described earlier.

When sensing the discharging state of the battery during the operation of the microwave oven in a pleasure boat or recreational vehicle, the long distance between the battery and the microwave oven may tend to cause voltage drop. This may lead to deteriorated accuracy in sensing the battery voltage.

Next, in the a-c/d-c microwave oven of the conventional type, separate fan motors, turntable motors and other motors are provided for different drive power sources, as shown in FIG. 6. That is, when driving the oven with the a-c power source AC, the fan motor *6a* and the turntable motor *7a*, both being a-c motors provided on the side of the a-c power source AC, are operated, and when driving the oven with the battery power source DC, the fan motor *6b* and the turntable motor *7b*, both being d-c motors provided on the side of the battery power source DC, are operated.

The microwave oven has safety measures consisting of switches SW1 through SW5 that interlock with the door to prevent magnetic waves from escaping outside the unit even when the door is opened during operation. SW3 is a monitor switch that opens when the door is closed.

When driving with a-c power, the voltage of the a-c power source AC is fed to the transformer 5 via the closed switches SW1 and SW2 (at this time SW3 remains opened) and boosted to a high voltage in the transformer 5 to feed to the magnetron 4 producing high-frequency energy.

When driving the oven with the d-c power, d-c voltage is applied via the closed switches SW4 and SW5 to the inverter 3, where the d-c voltage is converted to an a-c voltage to feed to the transformer 5.

With the arrangement shown in FIG. 6 above, provision of separate fan motors *6a* and *6b* and turntable motors *7a* and *7b* for a-c and d-c power sources would be contrary to the miniaturization requirement for such cardboard or shipboard equipment.

When the output of the inverter 3 is a commercial frequency of 50 Hz or 60 Hz, the fan motor *6a*, the turntable motor *7a* and other motors provided on the side of the a-c power source can be driven by a square-wave voltage induced in the primary winding of the transformer 5 when the oven is driven by the d-c power. If the inverter 3 is operated with a frequency higher than commercial frequency, 200 Hz, for example, commercial-frequency motors provided on the side of the a-c power source cannot be driven by such a high frequency.

Next, in the microwave oven of the conventional type, output changeover is performed in such a manner that when output is changed to the HIGH side, the timer switch TS provided on the power line, as shown in FIG. 7, is operated in the continuously ON state, and when output is changed to the LOW side, the timer switch TS is operated in the ON state for 5 seconds and then in the OFF state for the subsequent 5 seconds.

The microwave oven has safety measures consisting of three-stage switches SW1 through SW3 that interlock with the door to prevent magnetic wave from escaping outside the unit even when the door is opened during operation, as shown in FIG. 7. SW3 is a monitor switch that opens when the door is closed.

In FIG. 7, the voltage of the a-c power source AC is fed to the transformer 5 via the closed switches SW1 and SW2 (at this time SW3 remains opened) and boosted to a high voltage in the transformer 5 to feed to the mangetron 4 producing high-frequency energy.

With the output changeover arrangement in the conventional microwave oven using the timer switch TS, a special-purpose switch has to be provided. In the microwave oven having two a-c power sources or an a-c/d-c power source, two special-purpose switches have to be provided.

SUMMARY OF THE INVENTION

It is the first object of this invention to provide a small-sized, lightweight, a-c/d-c microwave oven having a small space for the transformer.

It is the second object of this invention to provide an a-c/d-c microwave oven having such a construction that the same a-c and d-c output voltages can be generated in a common secondary winding wound on a single transformer.

It is the third object of this invention to provide an a-c/d-c microwave oven having such a construction that when a battery power source is used, the battery power source is prevented from being overdischarged.

It is the fourth object of this invention to provide an a-c/d-c microwave oven having such a construction that the number of switches installed on the door can be reduced and power can be supplied to the magnetron safely and positively with the same magnetic-wave leakproof switch arrangement as the conventional type.

It is the fifth object of this invention to provide an a-c/d-c microwave oven having such a construction that a magnetic-flux leakage circuit for bypassing magnetic flux is provided between a first primary winding driven by an a-c power source and a secondary winding so that the oven can be driven by both a-c and d-c power with a single transformer.

It is the sixth object of this invention to provide an a-c/d-c microwave oven having such a construction that the discharging state of the battery can be sensed by sensing battery voltage at the zero-cross period of inverter current, that is, at the time when the inverter is interrupted, and there is no load and there is no voltage drop for the battery.

It is the seventh object of this invention to provide an a-c/d-c microwave oven having such a construction that an inverter is provided to generate a commercial-frequency a-c voltage having a capacity small enough to drive motors, etc. on the a-c power side on the basis of a battery power source.

It is the eighth object of this invention to provide an a-c/d-c microwave oven having an output changeover device so that the output of the microwave oven can be changed over by on-off controlling switches as safety means that close during the operation of the microwave oven.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE EMBODIMENTS

Figure 8:
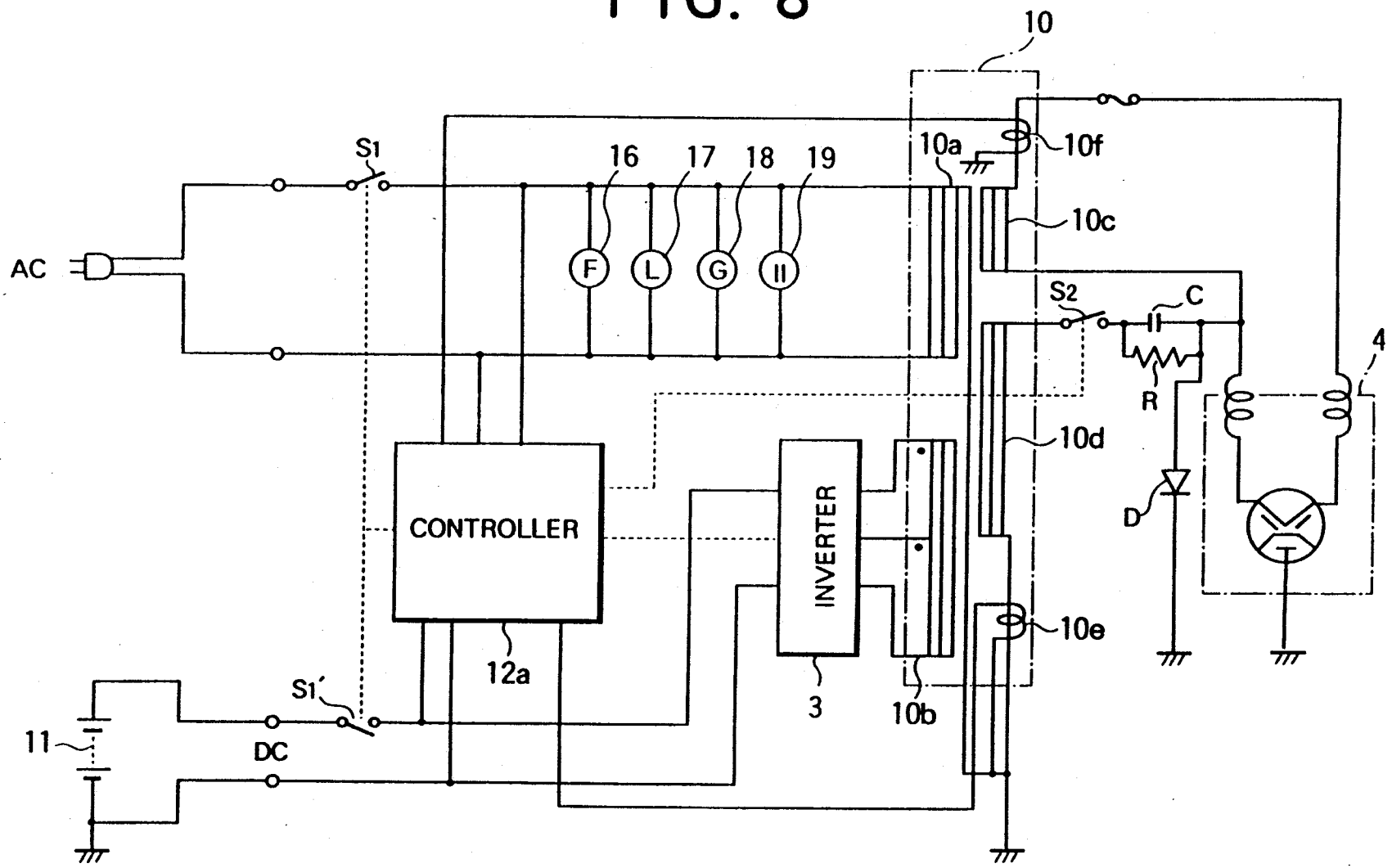
FIG. 8 is an electrical circuit diagram illustrating the first embodiment of this invention.

FIG. 8 is an electrical circuit diagram illustrating the first embodiment of this invention. Like parts are indicated by like reference numerals in FIGS. 1 through 7.

In FIG. 8, numeral 10 refers to a transformer; 10*a* to a first primary winding; 10*b* to a second primary winding; 10*c* to a first secondary winding; 10*d* to a second secondary winding; 10*e* and 10*f* to current transformers; 11 to a battery; 12*a* to a control circuit; 16 to a fan; 17 to an indicator lamp; 18 to a geared motor; 19 to a receptacle; $S_1$, $S_1'$ and $S_2$ to switches; and R to a resistor; respectively.

The embodiment shown in FIG. 8 is a microwave oven that can be driven either by an a-c power source or a battery 11 by operating the switches $S_1$ and $S_2$. That is, when the microwave oven is driven by an a-c power source, the magnetron 4 is driven by turning on a switch $S_1$, turning off a switch $S_1'$, and turning on a switch $S_2$ to apply an a-c voltage to a first primary winding 10*a* of a transformer 10, and double-voltage rectifying the high voltage induced in a second secondary winding 10*d*. When the microwave oven is driven by a d-c power source, on the other hand, the magnetron 4 is driven by turning off the switch $S_1$, turning on the switch $S_1'$ and turning on the switch $S_2$ to apply an a-c voltage to the second primary winding 10*b* of the transformer 10, and double-voltage rectifying the high voltage induced in the second secondary winding 10*d*. The frequency of the a-c voltage applied to the second primary winding 10*b* of the transformer 10 from the inverter 3 is selected at a frequency higher, 70–300 Hz, for example, than the frequency of an a-c power source, that is, commercial a-c power source.

In this way, by applying to a second primary winding 10*b* a frequency higher than the frequency (50/60 Hz) of the commercial a-c power source applied to a first primary winding 10*a*, the magnetic flux B in Equation (1) becomes about 13,000 gauss without leakage characteristics, and the peak value generated in the second secondary winding 10*d* of the transformer 10 can be made exactly the same voltage of the commercial a-c power source by setting the frequency f at a high value.

A first secondary winding 10c is provided to supply a heater current to the magnetron 4, and a current transformer 10f is provided to sense this heater current.

When the microwave oven is driven by a d-c power source, a fan 16 attached to the microwave oven, an indicator lamp 17, a geared motor 18 for driving the turntable, etc. are driven by an a-c voltage equal to the commercial voltage induced in the first primary winding 10a, and the same a-c voltage is also fed to a receptacle 19. When the microwave oven is driven by an a-c power source, too, the fan 16, the indicator lamp 17, the geared motor 18, etc. can be driven by the a-c power source, and the a-c voltage is supplied to the receptacle 19 only if the frequency thereof agrees with the frequency of the fan 16, the indicator lamp 17, the geared motor 18, etc. A current transformer 10e is provided to perform control in accordance with load current.

Figure 1:
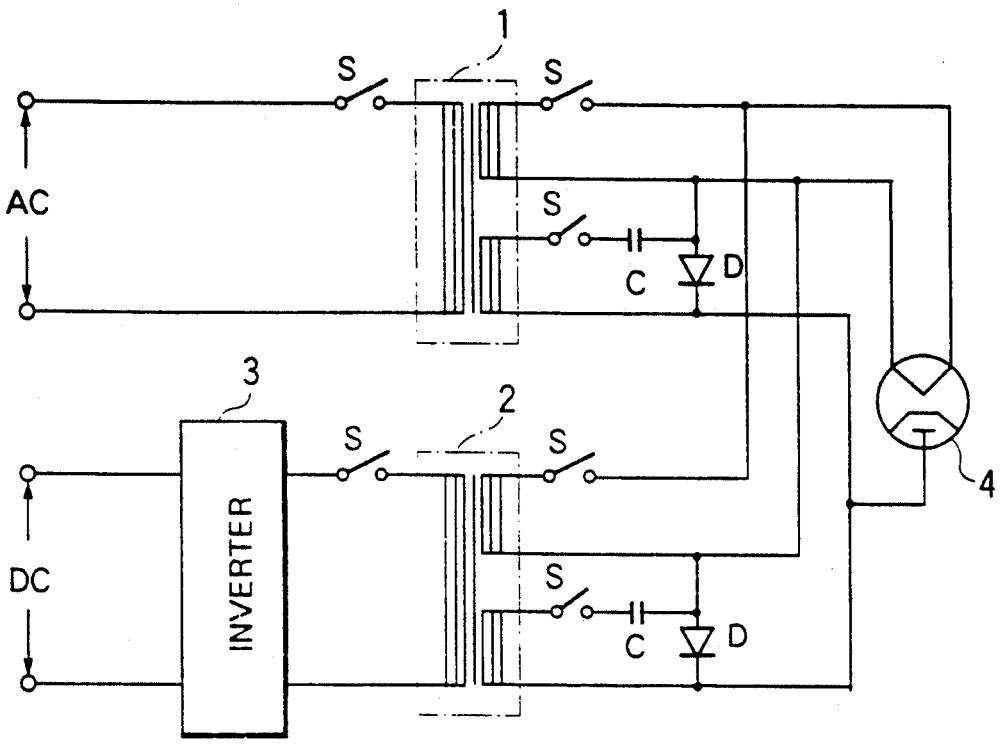
FIG. 1 (PRIOR ART)
FIG. 1 is an electrical circuit diagram illustrating the basic construction of an a-c/d-c microwave oven on which this invention is based.
Figure 2:
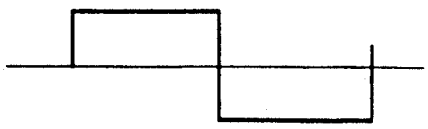
FIG. 2 (PRIOR ART)
FIG. 2 is a waveform diagram of a voltage applied to a magnetron from a battery power source via an inverter.
Figure 3:
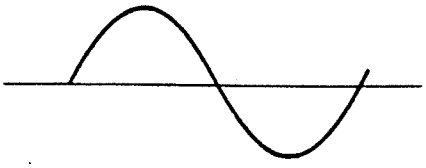
FIG. 3 (PRIOR ART)
FIG. 3 is a waveform diagram of an a-c voltage applied to a magnetron from an a-c power source.
Figure 4:
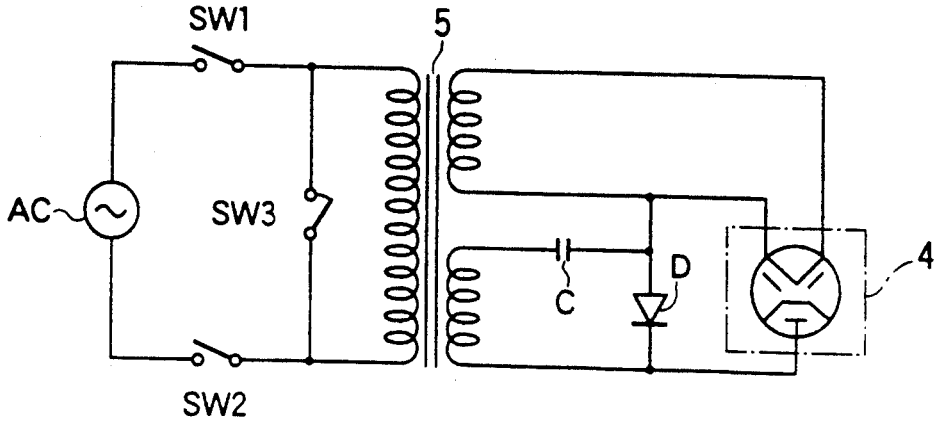
FIG. 4 (PRIOR ART)
FIG. 4 is an electrical circuit diagram illustrating a switch configuration in an example of the microwave oven having one power source.

In this way, the construction in which a single unit of the transformer 10 generating high voltage to the magnetron 4 is used makes the size of the transformer approximately two thirds as large as the size of the prior-art microwave oven (as shown in FIG. 1) having two transformers for an a-c power source and a d-c power source.

Figure 9:
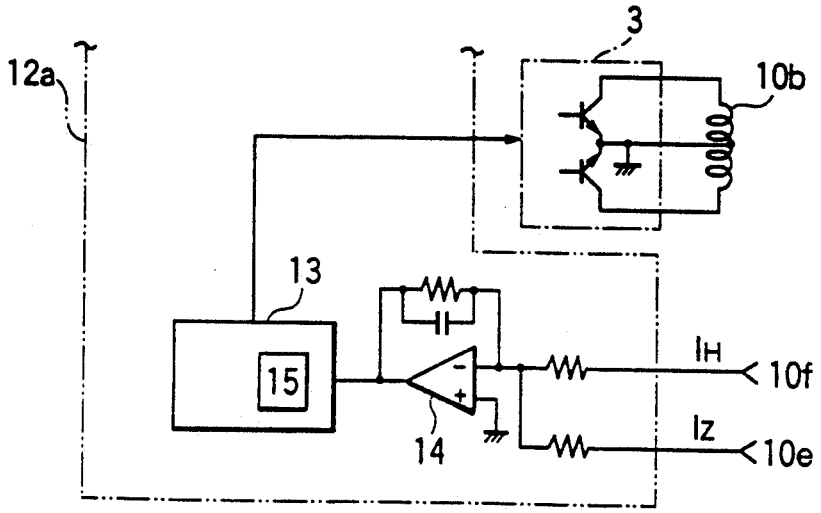
FIG. 9 is an electrical circuit diagram illustrating an example of the control section in FIG. 8.

FIG. 9 is an electrical circuit diagram illustrating an example of a control section 12a in FIG. 8. Like parts are indicated by like reference numerals in FIG. 8. In FIG. 9, numeral 13 refers to a CPU; 14 to an operational amplifier; and 15 to a frequency control section incorporated in the CPU 13, respectively.

When the microwave oven is driven by a d-c power source in FIGS. 8 and 9, a predetermined a-c voltage is generated by the inverter 3 in the first and second secondary windings 10c and 10d of the transformer 10. In this case, the voltage generated in the second secondary winding 10d can be kept at a constant level by changing the output frequency of the inverter 3 in accordance with the output current of the load current flowing in the magnetron 4 and the heater current flowing in the heater of the magnetron 4.

The load current $I_z$ flowing in the magnetron 4 is sensed by the current transformer 10e, and the heater current $I_H$ flowing in the magnetron 4 is sensed by the current transformer 10f. The load current $I_z$ and the heater current $I_H$ are added in the operational amplifier 14 to be delivered to the CPU 13. The frequency controls section 15 incorporated in the CPU 13 control the output frequency of the inverter 3 in accordance with changes in the output current ($I_z$ and $I_H$) delivered by the operational amplifier 14. That is, as the frequency of the a-c voltage applied to the second primary winding 10b changes, feedback is effected so that the voltage generated in the second secondary winding 10d is kept at a constant level.

Figure 10:
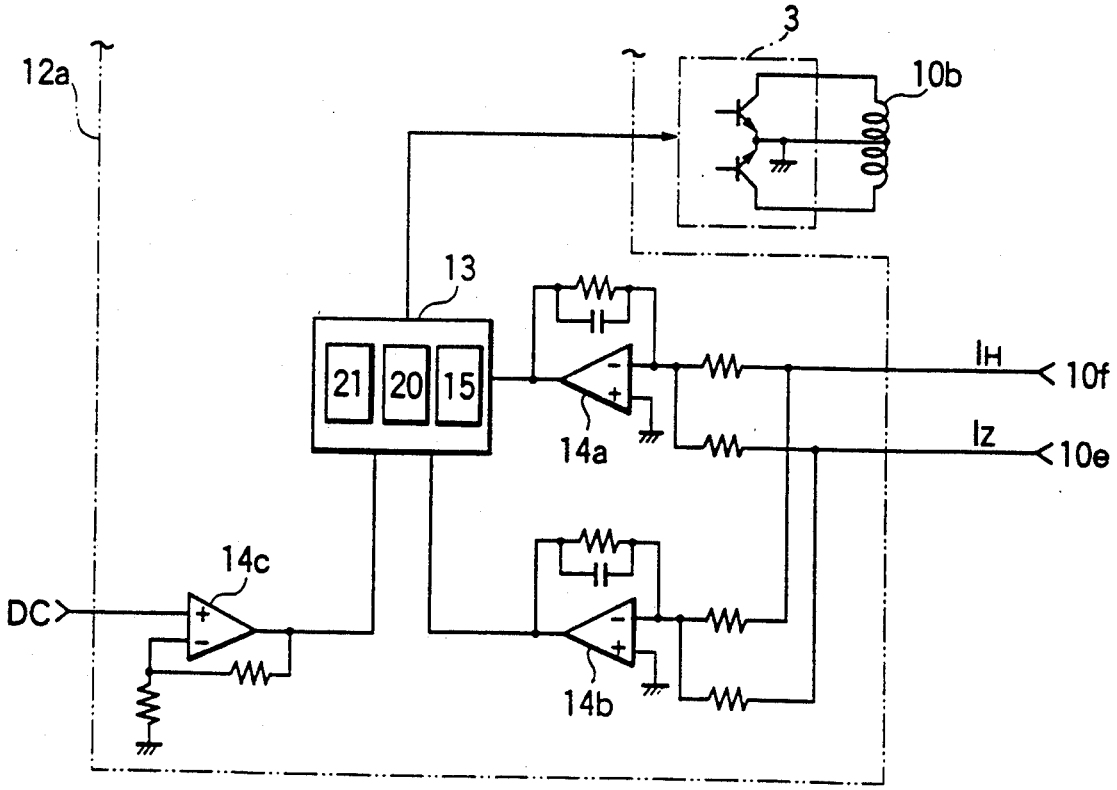
FIG. 10 is an electrical circuit diagram illustrating another example of the control section in FIG. 8.

FIG. 10 is an electrical circuit diagram illustrating another example of the control section 12a in FIG. 8. Like parts are indicated by like reference numerals in FIGS. 8 and 9. In FIG. 10, numerals 14a, 14b and 14c refer to operational amplifiers; 20 to a phase control section incorporated in the CPU 13; and 21 to an input voltage phase control section incorporated in the CPU 13. The operational amplifier 14a here corresponds with the operational 14 amplifier shown in FIG. 9.

The control section shown in FIG. 10 has a phase control section 20 to execute feedback to keep the voltage generated in the second secondary winding 10d shown in FIG. 8, in addition to the frequency control by the frequency control section 15, by controlling the duty ratio of the a-c voltage delivered by the inverter 3 phase control section 20 adjusts voltage in the second secondary winding 10d in accordance with the added value of the load current $I_z$ and the heater current $I_H$ added by the operational amplifier 14b. The input voltage phase control section 21 can execute feedback to keep the voltage generated in the second secondary winding 10d at a constant level by controlling the duty ratio of the a-c voltage delivered by the inverter 3 in accordance with the voltage value of the battery 11 sensed by the operational amplifier 14c through the processing of the input voltage phase control section 21. By adopting this construction, the voltage generated in the second secondary winding 10d can be kept at a more appropriate level.

Figure 11:
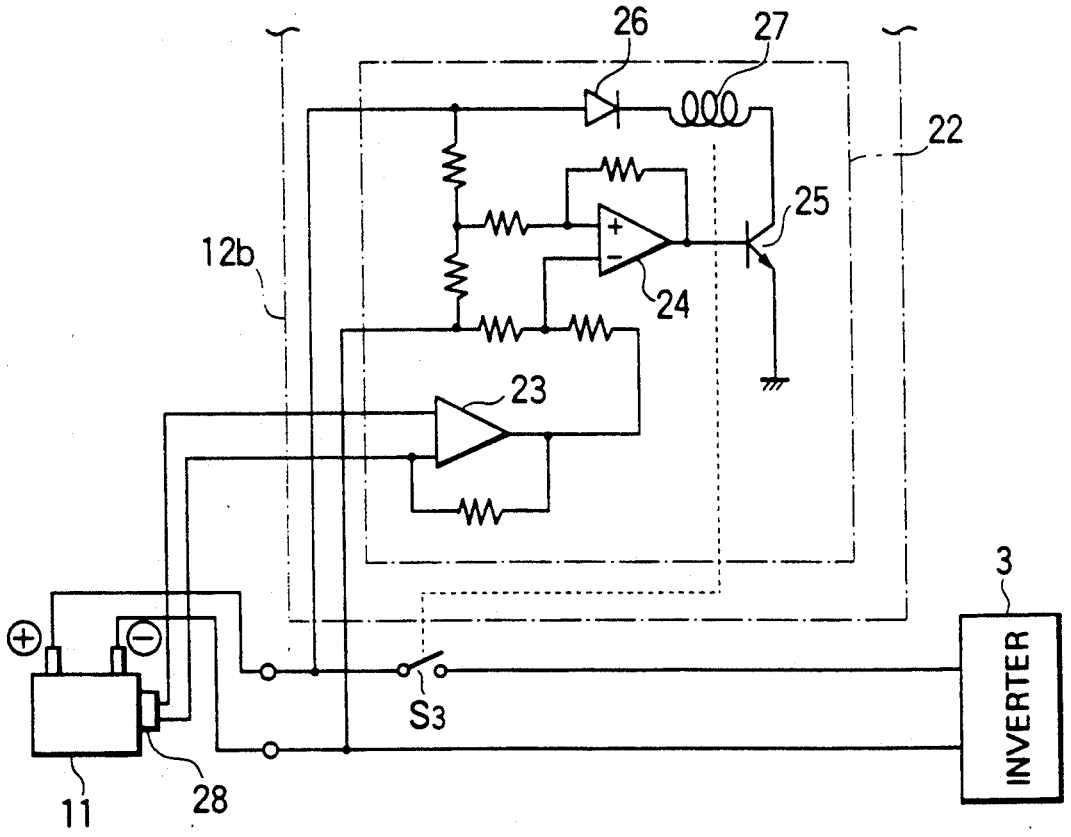
FIG. 11 is an electrical circuit diagram illustrating an example of the control section in the second embodiment of this invention.

FIG. 11 is an electrical circuit diagram illustrating an example of the control section in the second embodiment of this invention, corresponding to the control section 12a in FIG. 8 above.

In the a-c/d-c microwave oven shown in FIG. 8, when the oven is driven by a d-c power source using a battery 11, consideration must be paid to prevent the overdischarging of the battery 11. To this end, the control section 12b having a battery monitor shown in FIG. 11 is employed in this invention. Numeral 22 in FIG. 11 indicates a battery monitor control section; 23 an amplifier; 24 a comparator; 25 a transistor; 26 a diode; 27 an exciting coil of a switch $S_3$; and 28 a temperature sensor. Other like numerals correspond to like parts in FIG. 8.

In this embodiment, a first means is provided for monitoring the terminal voltage of battery 11 and for interrupting power feeding to a load if the terminal voltage of a battery 11 falls below a predetermined threshold value. A second means monitors and interrupts power feeding to a load if the voltage and temperature of the battery 11 exceed a predetermined value. These control functions are performed in the battery monitor control section 22 provided in the control section 12b.

In FIG. 11, when the terminal voltage of the battery 11 remains within a normal range, or when the temperature of the battery 11 remains within a normal range, the output of the comparator 24 is kept on a HIGH level. Consequently, the transistor 25 is kept in the ON state, the exciting coil 27 is energized, and the switch $S_3$ is kept in the ON state. If the terminal voltage of the battery 11 falls below a predetermined value, however, the output of the comparator 24 changes to a LOW level, causing the transistor 25 to turn into the OFF state. As a result, the exciting coil 27 is deenergized, causing the switch $S_3$ to turn into the OFF state to interrupt power feeding to the inverter 3.

The level of the negative terminal of the comparator 24 is changed via the amplifier 23 in accordance with the sensed temperature of the battery 11, and the threshold value of the voltage is also changed in accordance with the above-mentioned temperature.

Figure 12:
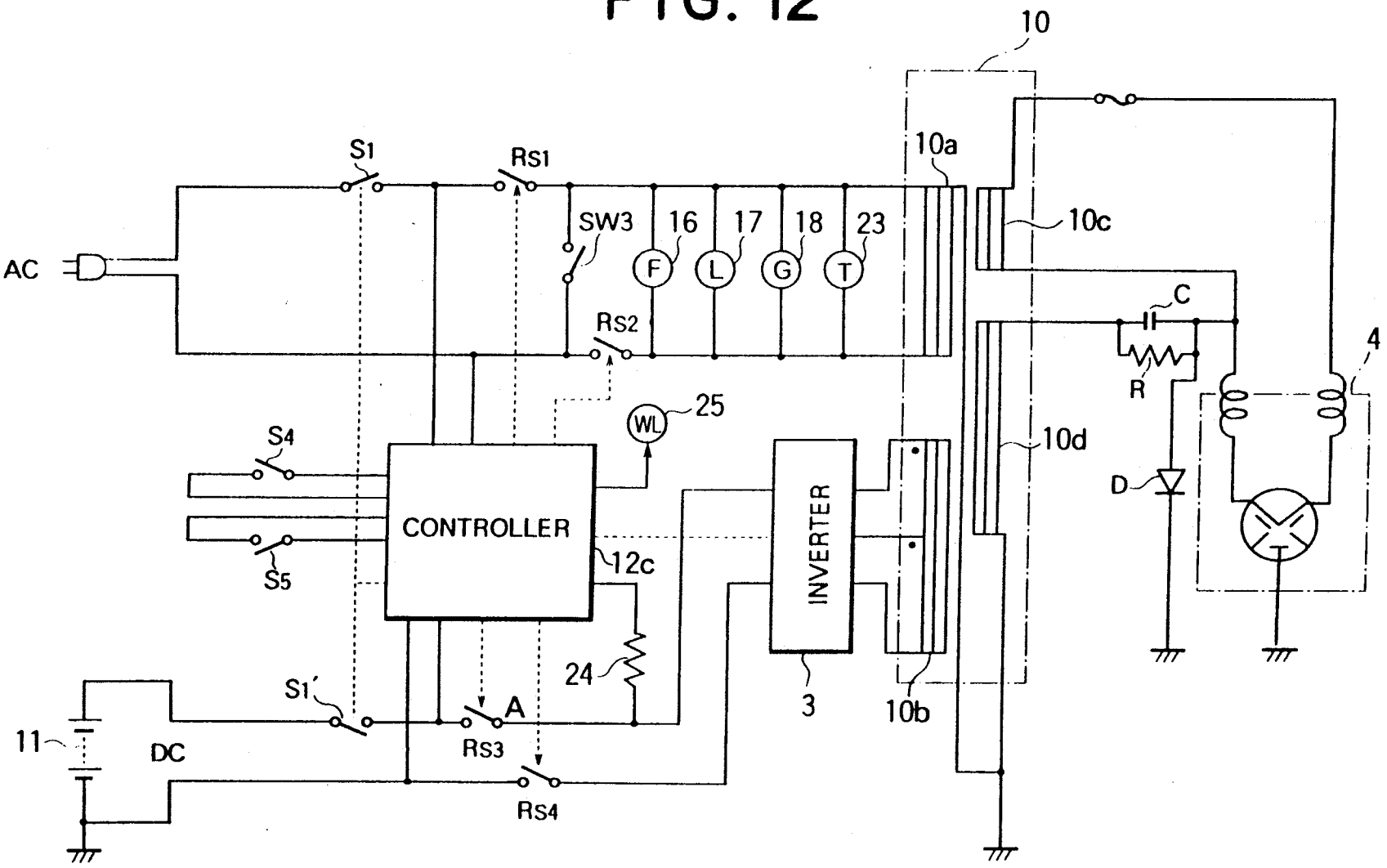
FIG. 12 is an electrical circuit diagram illustrating the third embodiment of this invention.

FIG. 12 is an electrical circuit diagram illustrating the third embodiment of this invention. Like parts are indicated by like reference numerals in FIGS. 1 through 11. In FIG. 12, numeral 12C refers to a control section; $Rs_1$ through $Rs_4$ to relay contacts adapted to be opened and closed by relays, which will be described later; 23 to a timer motor driven by the a-c power source AC, for example, in the same manner as the fan 16, the indicator lamp 17, the geared motor 18 for driving the turntable;

$S_4$ and $S_5$ to door switches that operate in accordance with the opening and closing state of the microwave oven door; 24 to a resistor; and 25 to a warning lamp, respectively.

Figure 13:
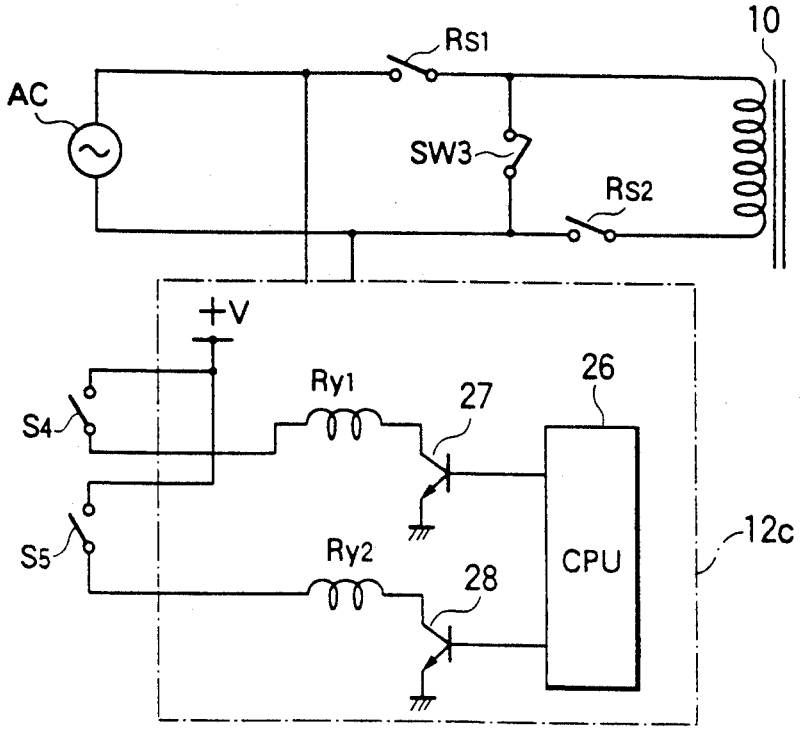
FIG. 13 is an electrical circuit diagram illustrating the essential part of the a-c power source and the control section in FIG. 12.

FIG. 13 is an electrical circuit diagram illustrating the essential part of the a-c power source and the control section 12C shown in FIG. 12. Like parts correspond to like numerals in FIG. 12 above. In FIG. 13, numeral 26 refers to a CPU; 27 and 28 to transistors; and $Ry_1$ and $Ry_2$ to relays, respectively. The control section 12C is adapted so as to be operated by a d-c voltage obtained by rectifying the a-c voltage of the a-c power source using a rectifying means (not shown).

The control section 12C has a circuit, such as a CPU 26, for feeding base current to the transistor 27 or 28 corresponding to the a-c power source to be used. The relays $Ry_1$ and $Ry_2$ are connected to the collector sides of the transistors 27 and 28. The relays $Ry_1$ and $Ry_2$ are also connected to the positive-pole side of the d-c power source via the door switches $S_4$ and $S_5$.

Figure 5:
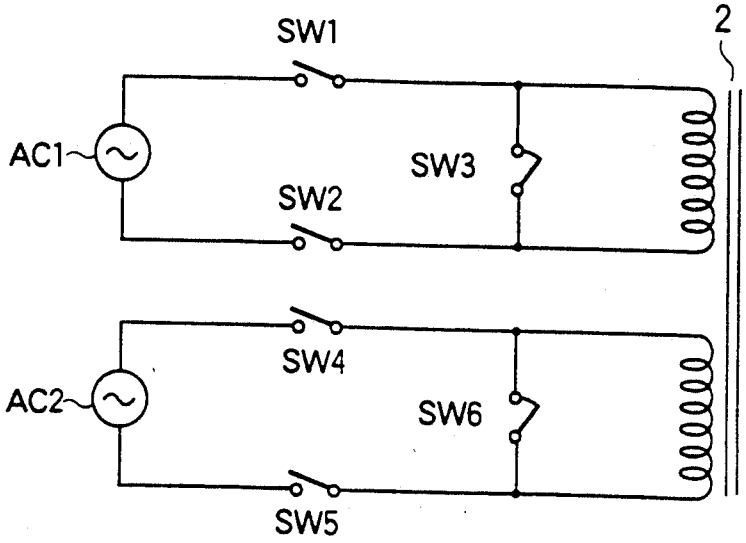
FIG. 5 (PRIOR ART)
FIG. 5 is an electrical circuit diagram illustrating a switch configuration in an example of the microwave oven having two power sources.
Figure 6:
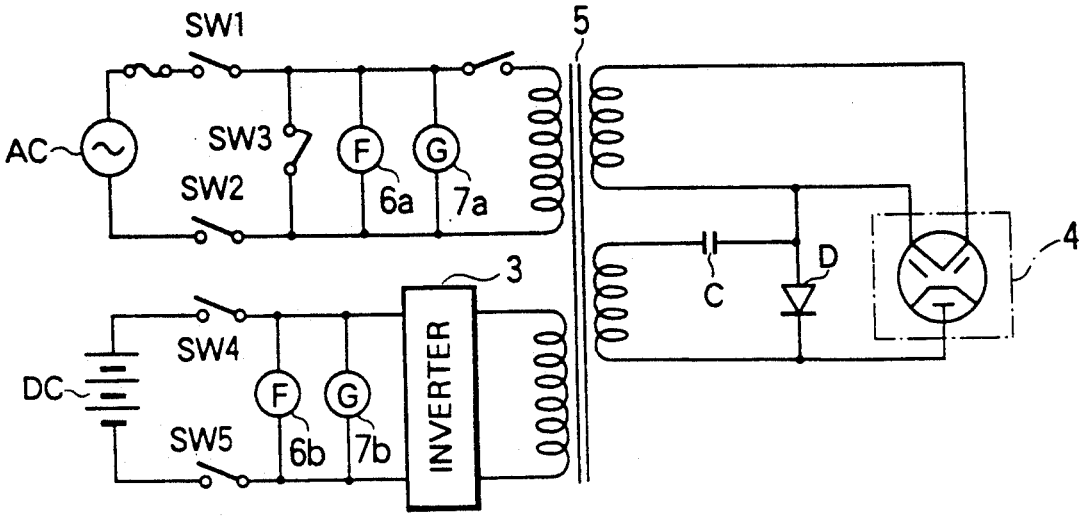
FIG. 6 (PRIOR ART)
FIG. 6 is an electrical circuit diagram illustrating an a-c/d-c microwave oven of a conventional type.
Figure 7:
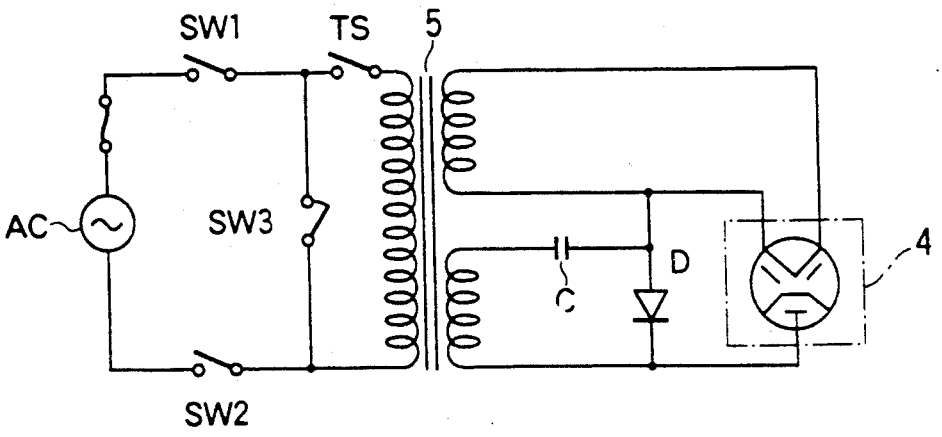
FIG. 7 (PRIOR ART)
FIG. 7 is an electrical circuit diagram illustrating a switch configuration in another example of the microwave oven having one power source.

The contacts $Rs_1$ and $Rs_2$ of the relays $Ry_1$ and $Ry_2$ are connected to the power lines of the a-c power source to form a construction corresponding to the switches $SW_1$ and $SW_2$ in FIG. 5.

As is evident from FIG. 13, the door switches $S_4$ and $S_5$ may be of a current capacity sufficient to drive the relays $Ry_1$ and $Ry_2$, that is, small-sized microswitches, for example. The contacts $Rs_1$ and $Rs_2$ of the relays $Ry_1$ and $Ry_2$ may also be of a contact capacity corresponding to the capacity of the a-c power source, and as such they can easily turn on and off large current.

Figure 14:
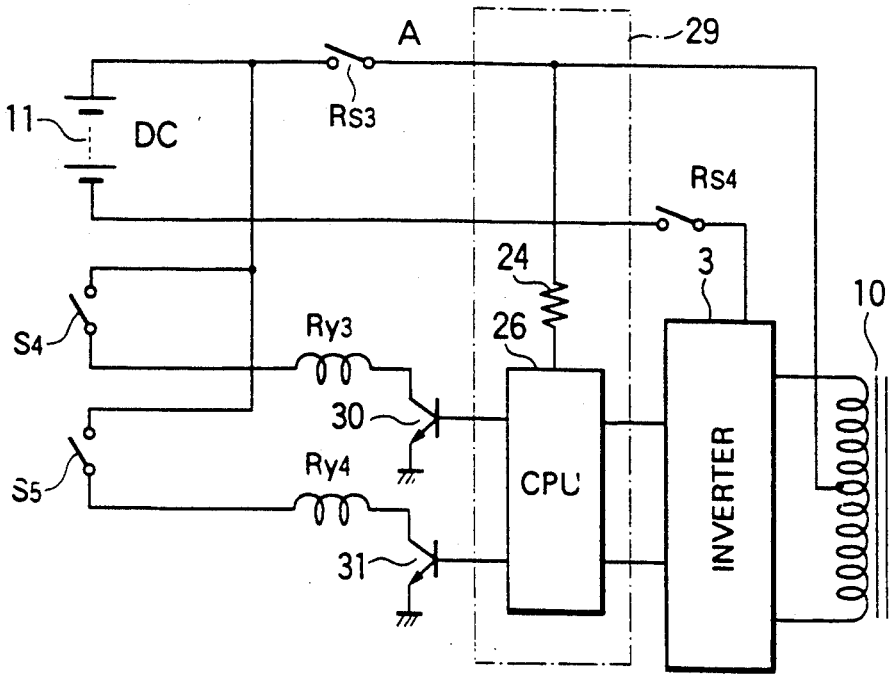
FIG. 14 is an electrical circuit diagram illustrating the other essential part of the battery power source and the control section in FIG. 12.
Figure 15:
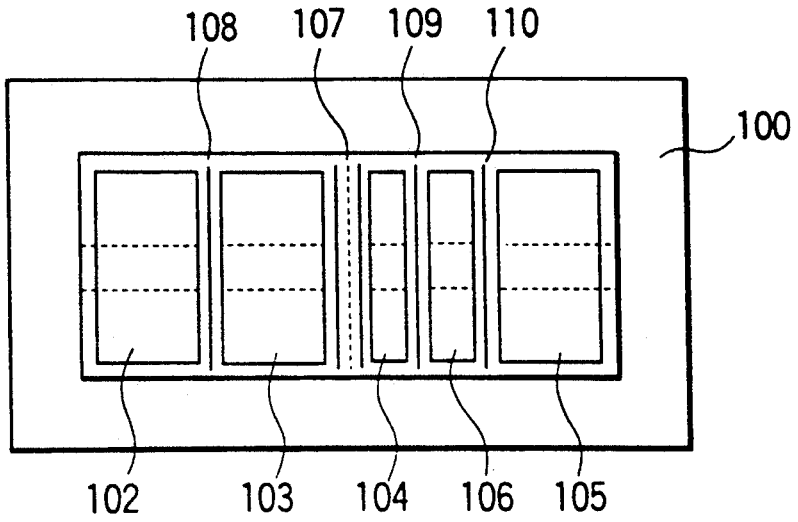
FIGS. 15 through 18 are a winding layout diagram, left-hand perspective view, right-hand perspective view and winding circuit diagram illustrating a transformer in the fourth embodiment of this invention.
Figure 16:
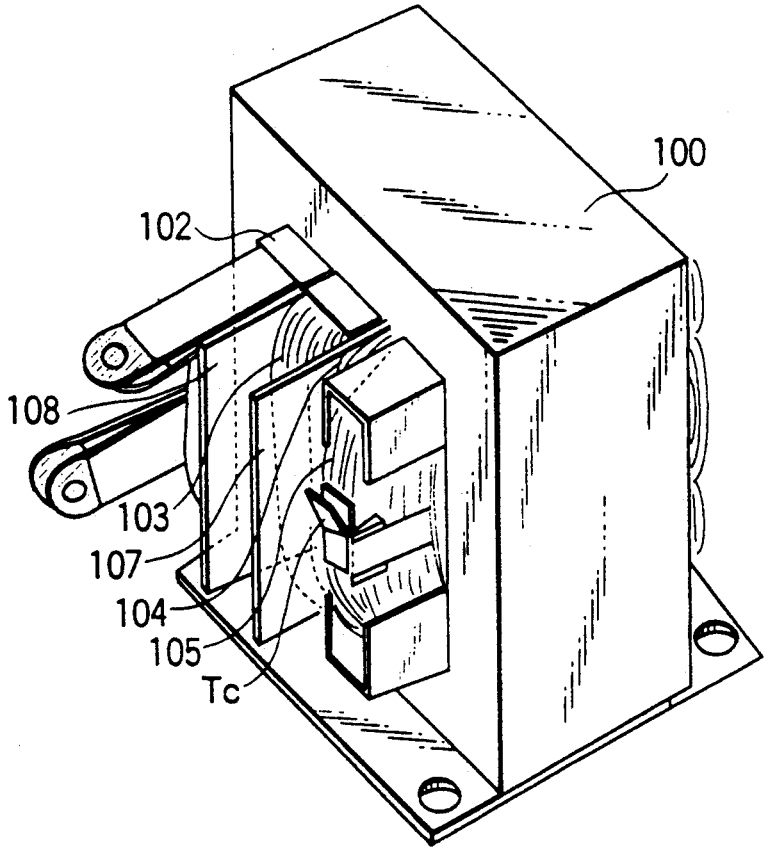
Figure 17:
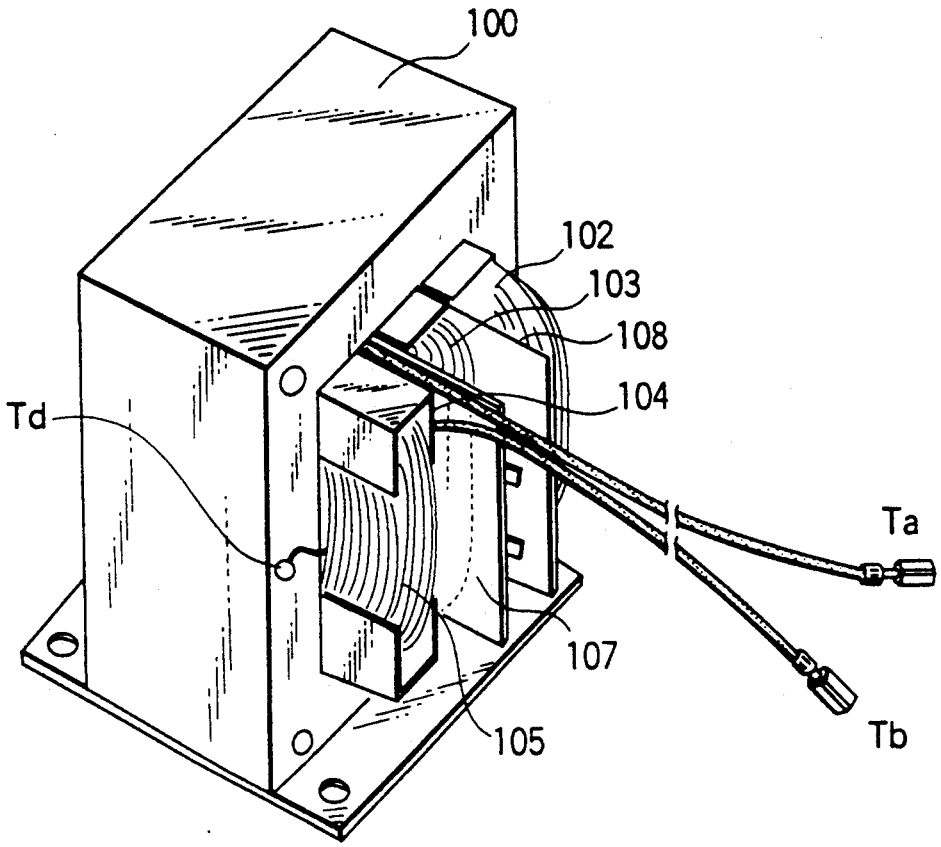

FIG. 14 is an electrical circuit diagram illustrating the other essential part of the battery power source DC and the control section 12C shown in FIG. 12. Like parts are indicated by like numerals in FIG. 12. In FIG. 14, $Ry_3$ and $Ry_4$ refer to relays; 29 to a relay-contact monitoring section; and 30 and 31 to transistors, respectively.

The relay-contact monitoring section 29 has the above-mentioned CPU 26 of FIG. 13 and the resistor 24 of FIG. 12, and senses the potential on the A side of the contact $RS_3$ of the relay $Ry_3$.

When the d-c power source comprising the battery 11 is used, the information that the d-c power is used to drive the microwave oven is given to the CPU 26 via a means not shown in the figure. Thus, the CPU 26 feeds base current to the transistors 30 and 31, putting the oven into the standby state.

It is possible that the contact $Rs_3$ of the relay $Ry_3$ can be brought into the normally closed state due to fusion or any other reasons, even if the door is kept open, that is, even if the door switch $S_4$ is opened and the relay $Ry_3$ is deenergized, the contact $Rs_3$ remains closed. When this happens the voltage of the battery power source 11 is kept applied to the A side. As this potential is sensed by the CPU 26 via the resistor 24, the CPU 26 interrupts the feeding of drive signal to the transistor (not shown) in the inverter 3. This interrupts the operation of the transformer 10, causing power feeding to the magnetron 4 (refer to FIG. 12) to be discontinued. That is, a function similar to the monitor switch $SW_6$ as shown in FIG. 5 is performed.

Consequently, a construction essentially similar to the three-stage switching configuration of the prior art can be achieved, and the monitor switch $SW_6$ can be eliminated by providing the relay-contact monitoring section 29 shown in FIG. 14. This allows the number of switches provided on the door to be reduced.

The a-c/d-c microwave oven shown in FIG. 12 employs the construction shown in FIG. 13 on the side of the a-c power source AC, as shown above, and employs the construction shown in FIG. 14 on the side of the d-c battery power source. The microwave oven can therefore be driven by either of an a-c power source, that is, the commercial power source, or a d-c power source, that is, the d-c power source using the battery 11 by operating the switches $S_1$, $S_1'$ and $S_2$.

At this time, the door switches $S_4$ and $S_5$ provided on the door, and the switch $SW_3$ are operated in accordance with the opening and closing state of the microwave oven door. Needless to say, therefore, the contacts $Rs_1$ through $Rs_4$ of the relays $Ry_1$ through $Ry_4$ are operated in accordance with the above-mentioned description by the control section 12C.

When the microwave oven is driven by the d-c power source, an abnormality, such as failure of the contact $Rs_3$ of the relay $Ry_3$ due to fusion, is detected via the resistor 24, and the warning lamp 25 is lighted up in the control section 12C. At the same time, the inverter 3 is interrupted, as described earlier.

Even when the microwave oven is driven by the d-c power source, the fan 16, the indicator lamp 17, the geared motor 18 for driving the turntable, and the timer motor 23 installed on the microwave oven are driven by an a-c voltage equivalent to the commercial power source induced in the first primary winding 10*a*.

When the microwave oven is driven by the a-c power source AC, the fan 16, the indicator lamp 17, the geared motor 18 for driving the turntable, and the timer motor 23 are operated by the a-c voltage of the a-c power source so long as the frequency of the a-c voltage of the a-c power source agrees with that of the fan 16, the indicator lamp 17, the geared motor 18, etc.

Figure 18:
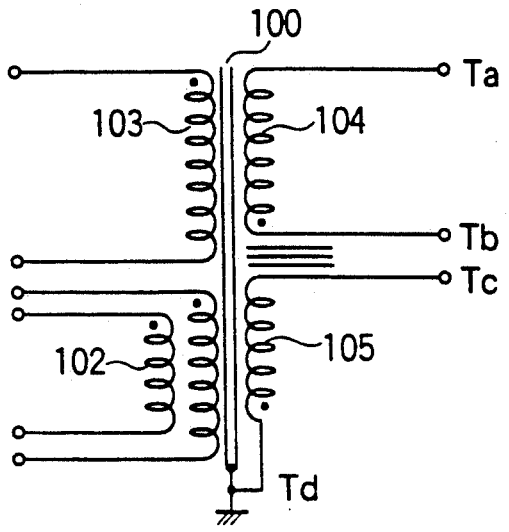

FIGS. 15 through 18 are a winding layout diagram, left-hand perspective view and right-hand perspective view of the transformer used in the fourth embodiment of this invention. In the figures, a second primary winding 102 driven by the d-c power source via the inverter, a first primary winding 103 driven by the a-c power source, a filament winding 104 as the heater power source for the magnetron, and a secondary winding 105 common to the a-c and d-c power sources are wound on an iron core 100 formed by combining an E-shaped core and an I-shaped core, or two E-shaped cores. A pass core 106 is formed in the iron core 100 for bypassing magnetic flux between the filament winding 104 and the secondary winding 105. With this arrangement, leakage characteristics can be obtained as the magnetic flux generated in the first primary winding 103 passes in the pass core 106. Furthermore, the second primary winding 102 has a two-winding construction that allows a push-pull connection, as shown in FIG. 18.

A shielding material 107 is interposed between the first primary winding 103 and the filament winding 104. Numerals 108, 109 and 110 refer to insulating materials.

Ta and Tb are lead terminals of the filament winding 104, and Tc and Td are lead terminals of the secondary winding 105, with the lead terminal Td being grounded via the transformer core 100.

Figure 19:
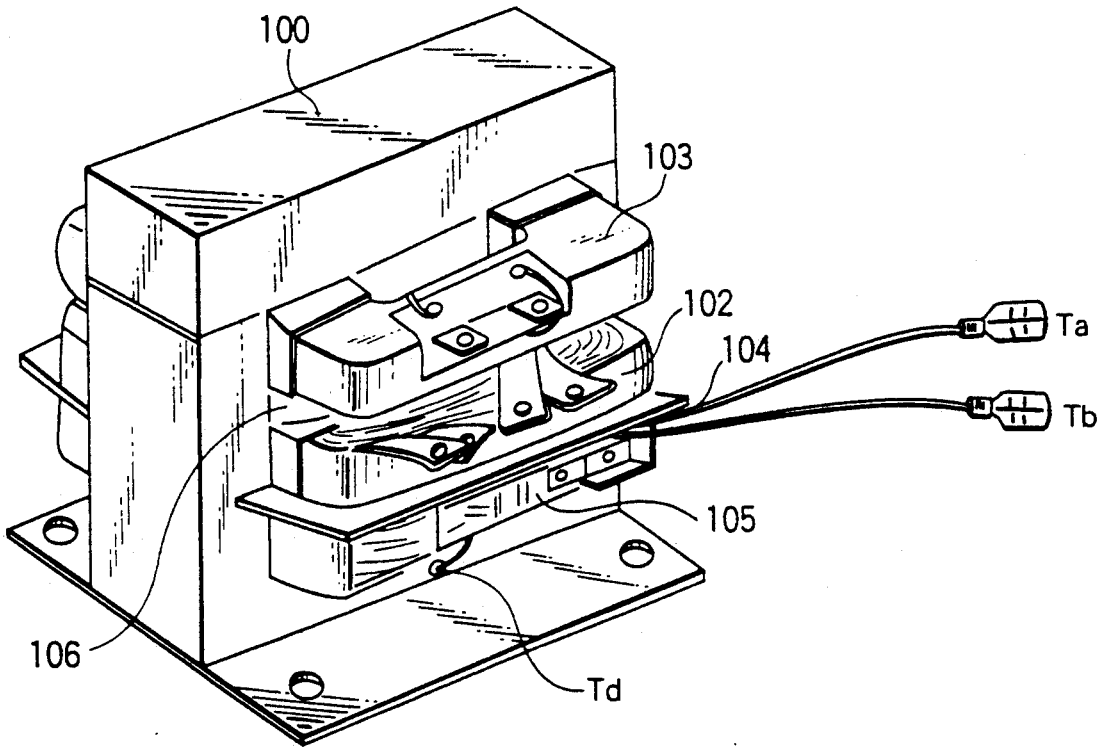
FIG. 19 is a perspective view illustrating a transformer in the fifth embodiment of this invention.

In some case, magnetic flux should not be allowed to leak between the second primary winding 102 driven by the d-c power source and the secondary winding. FIG. 19 is a perspective view of a transformer to cope with such a case. Like numerals indicate like parts shown in FIGS. 15 through 18.

A first primary winding 103 driven by the a-c power source, a second primary winding 102 driven by the d-c power source via the inverter, a filament winding 104 (not shown) used as the heater power source for the magnetron, and a secondary winding 105 common to the a-c and d-c power sources are wound on an iron core 100. A pass core 106 is formed in the iron core 100 for bypassing magnetic flux between the first primary winding 103 and the second primary winding 102 so that no-leakage characteristics involving no magnetic flux leakage can be obtained between the second primary winding 102 and the secondary winding 105. On the other hand, leakage characteristics can be obtained as magnetic flux leaks between the first primary winding 103 and the secondary winding 105 via the pass core 106 formed in the iron core 100.

Figure 20:
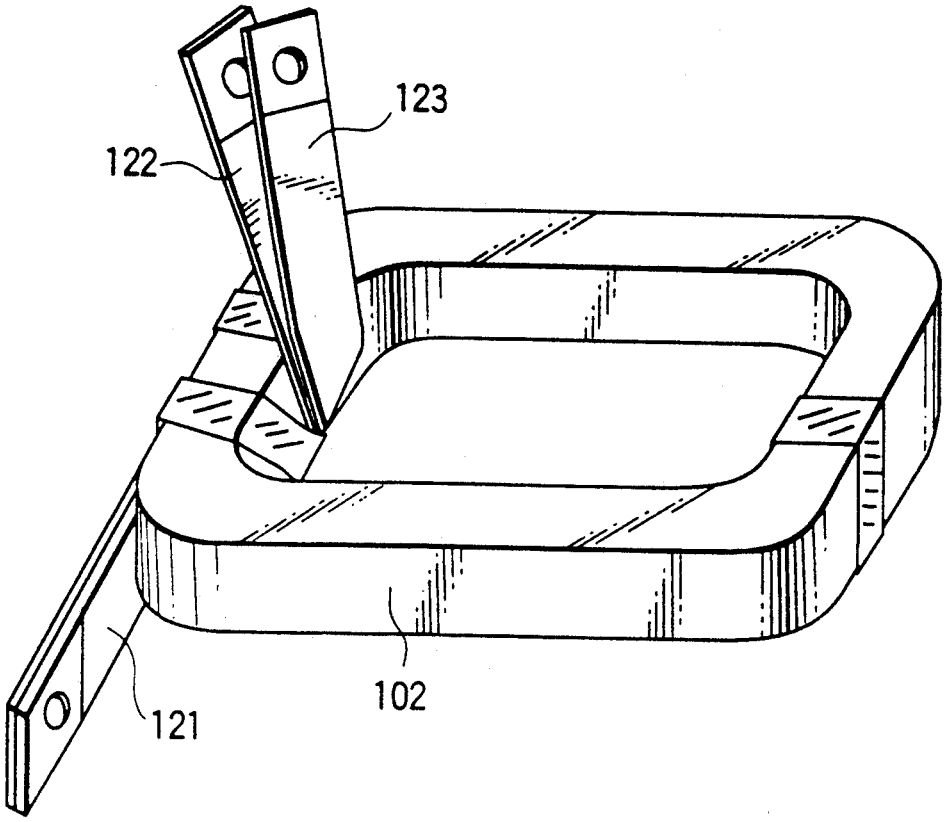
FIGS. 20 through 22 are diagrams of assistance in explaining the state of drawing out the lead terminals of primary windings, the forming of lead strips, and the take-off of the lead strips in the transformer shown in FIGS. 15 through 19.

FIG. 20 is a diagram of assistance in explaining the state of drawing out the lead terminals of the second primary winding 102 driven by the d-c power source.

Figure 21:
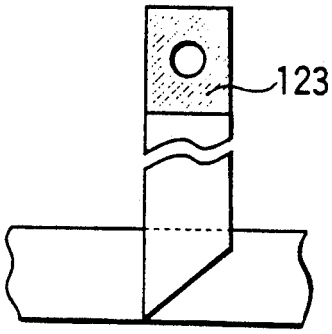

In the figure, each leading end of the two windings of the formed second primary winding 102 is connected to each other and mounted on a lead strip 121. Each trailing end of the two windings of the second primary winding 102 is connected to each other and mounted on lead strips 122 and 123, respectively, and then drawn out along the formed second primary winding and bent at right angles, as shown in FIG. 21. The other lead strip 122 is also similarly bent at right angles.

Figure 22:
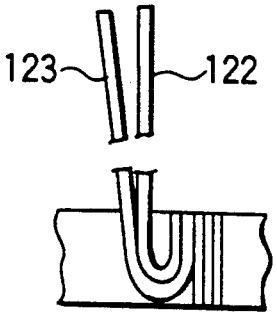

FIG. 22 is a diagram of assistance in explaining the state of drawing out the leading strips; a side view viewed from the right side of FIG. 21. As shown in FIG. 22, appropriate lengths of the lead strips 122 and 123 are drawn out.

As is obvious from description made in connection with FIGS. 20 through 22, the second primary winding 102 forms a push-pull connection; with the lead strip 121 being a neutral point and the lead strips 122 and 123 being terminals.

A transformer having the aforementioned construction can be effectively used as the transformer 10 shown in FIGS. 8 and 12 above.

Figure 23:
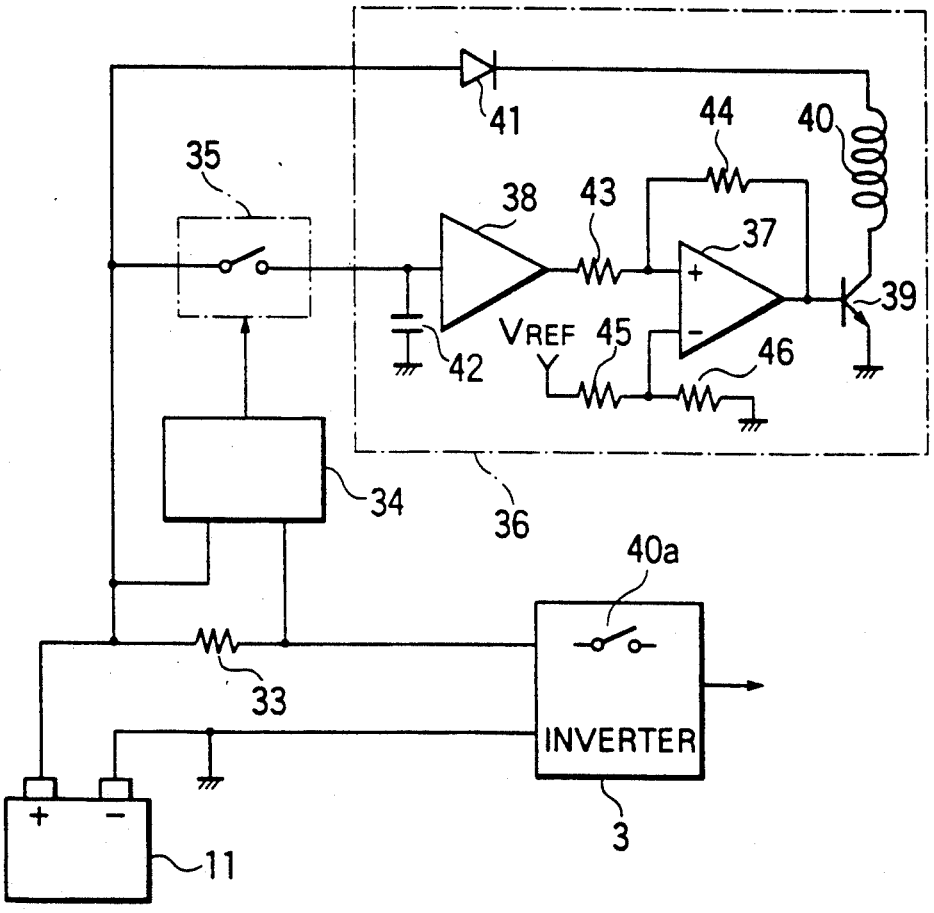
FIG. 23 is a diagram of assistance in explaining an example of the battery voltage sensor in the sixth embodiment of this invention.
Figure 24:
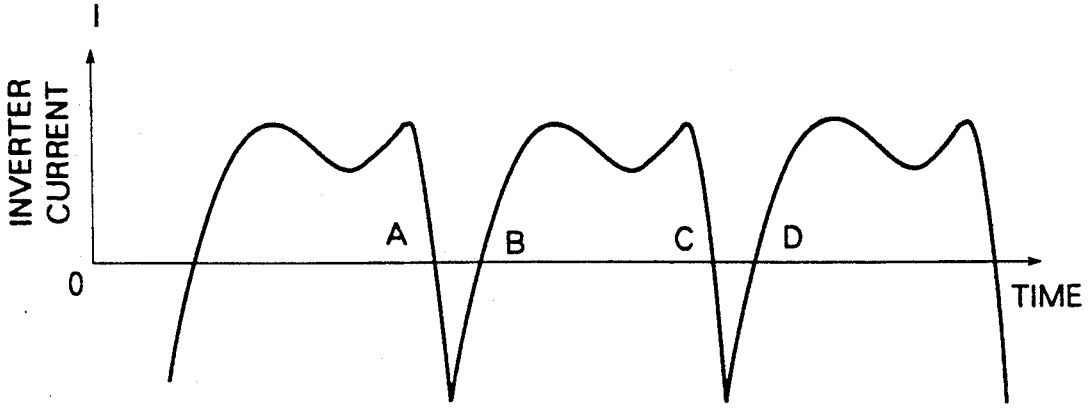
FIG. 24 is a diagram of assistance in explaining the waveform of inverter current.
Figure 25:
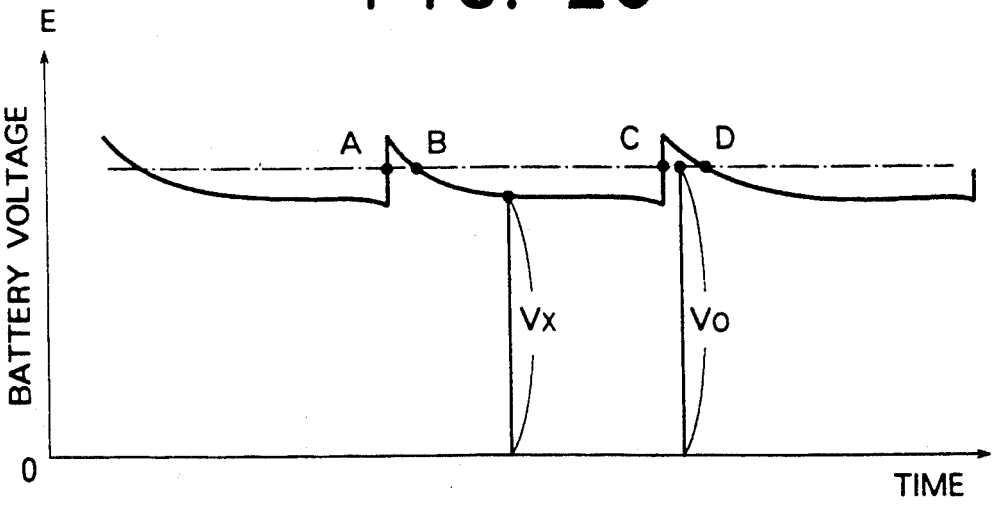
FIG. 25 is a diagram of assistance in explaining the waveform of battery voltage.

FIG. 23 is a diagram of assistance in explaining an example of the battery voltage sensor in the sixth embodiment of this invention. FIGS. 24 and 25 are an inverter current waveform diagram and a battery voltage waveform diagram. Like parts are indicated by like numerals used in the aforementioned embodiments.

In FIG. 23, numeral 33 refers to a shunt resistor; 34 to a zero-cross sensor; 35 to an analog switch; 36 to a battery monitor; 37 to a comparator; 38 to a buffer amplifier; 39 to a transistor; 40 to a relay coil; **40*a* to a relay contact; 41 to a diode; 42 to a capacitor; and 43 through 46** to resistors, respectively.

When the microwave oven is driven by the d-c power source using the battery 11, large current flows from the battery 11 to the inverter 3. Since the inverter 3 is turned on and off, however, the current flowing in the shunt resistor 33 takes a waveform as shown in FIG. 24.

The zero-cross sensor 34 detects points A, B, C and D at which the waveform of the current flowing in the shunt resistor 33 intersects the zero level, and generates an output signal at the current waveform points A, B, C and D, turning on the analog switch 35. That is, the zero-cross sensor 34 generates an output signal when the battery 11 has no load, turning on the analog switch 35.

Consequently, when the battery 11 has no load, the voltage of the battery 11 is inputted to sensed by the battery monitor 36 via the analog switch 35.

The voltage of the battery 11 sensed by the battery monitor 36 is delivered the comparator 37 via the buffer amplifier 38 to compare with a reference voltage divided by resistors 45 and 46.

The terminal voltage of the battery 11, on the other hand, takes a voltage waveform as shown in FIG. 25 by the on-off operation of the inverter 3. A, B, C and D are so-called no-load voltages. The no-load voltages are compared with the reference voltage level divided by resistors 45 and 46. When the level of the no-load voltage of the battery 11 is larger than the reference voltage level, the comparator 37 outputs an H level. At this time, the transistor 39 is kept in the ON state, holding the driving state of the inverter 3. When the level of the no-load voltage of the battery 11 is smaller than the reference voltage level, the comparator 37 outputs an L level. With the L level outputted by the comparator 37, the transistor 39 is turned off, preventing current from flowing in the relay coil 40. Thus, the contact **40*a* of the relay is opened, interrupting the operation of the inverter 3. Consequently, the operation of the microwave oven by the battery 11 is discontinued, and the overdischarging of the battery 11** is prevented.

Figure 26:
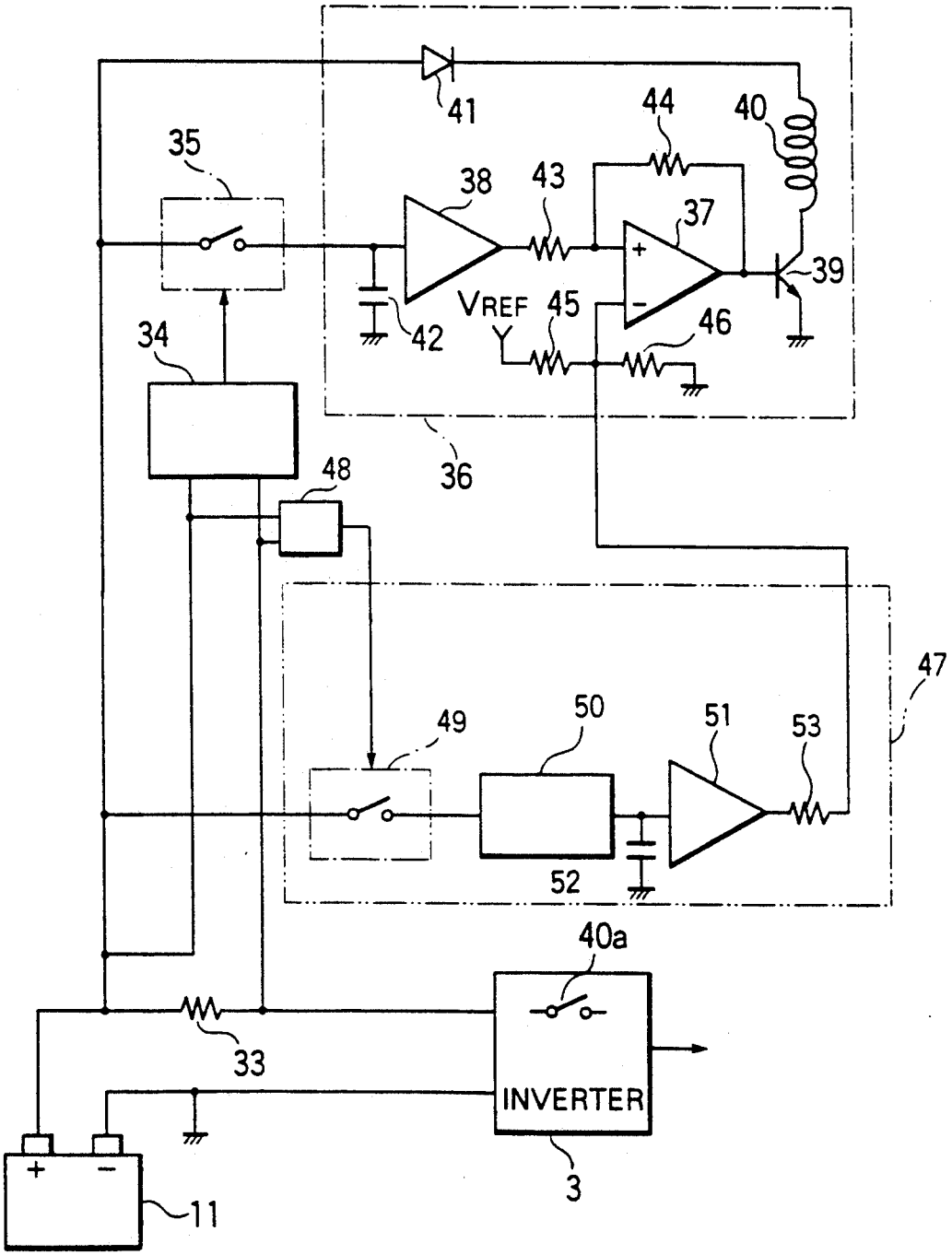
FIG. 26 is a diagram of assistance in explaining an example of the on-load battery voltage sensor in the seventh embodiment of this invention.

FIG. 26 is a diagram of assistance in explaining the construction of an example of the on-load battery voltage sensor in the seventh embodiment of this invention. Like parts are indicated by like numerals in FIG. 23.

In FIG. 26, numeral 47 refers to an on-load voltage sensor; 48 to a current level sensor; 49 to an analog switch; 50 to a voltage holding circuit; 51 to a buffer amplifier; 52 to a capacitor; and 53 to a resistor, respectively.

The current level sensor 48 sends a signal to the analog switch 49 when the waveform of current flowing in the shunt resistor 33 is a certain level. In FIGS. 24 and 25, therefore, when the current waveform is a certain level, the analog switch 49 is turned on, and the on-load voltage $V_x$ of the battery 11 at that time is detected and held in the voltage holding circuit 50.

This no-load voltage $V_x$ is delivered inputted to the connecting point of the resistors 45 and 46 of the battery monitor 36 via the buffer amplifier 51.

Since the no-load voltage $V_o$ at point C of the same current waveform is detected to the battery monitor 36, the no-load voltage $V_o$ is sent to the comparator 37, and the difference between the no-load voltage $V_o$ and the on-load voltage $V_x$ at point x is calculated. When this difference between the no-load voltage $V_o$ and the on-load voltage $V_x$ is smaller than a predetermined value, the comparator outputs an H level. That represents the state in which the internal resistance of the battery 11 is sufficiently small, and the charging state of the battery is good.

When the difference between the no-load voltage $V_o$ and the on-load voltage $V_x$ is larger than a predetermined value, the comparator 37 outputs an L level. With the L level generated by the comparator 37, the transistor 39 is turned off, interrupting the current flow in the relay coil 40. This causes the contact **40*a* to open, stopping the operation of the inverter 3. That represents the state where the internal resistance of the battery 11 is large, and the battery 11 is in the vicinity of overdischarging. In this state, the operation of the microwave oven by the battery 11 is interrupted, and the overdischarging of the battery 11** is prevented.

In this way, the circuit configuration shown in FIG. 26 can detect the overdischarging of the battery 11 in the on-load state, and stop the operation of the microwave oven by the battery 11.

The above description is concerned with the current waveform at point B. In the case of other current waveforms, however, the voltage of the battery 11 in the on-load state can be detected by the on-load voltage sensor.

Figure 27:
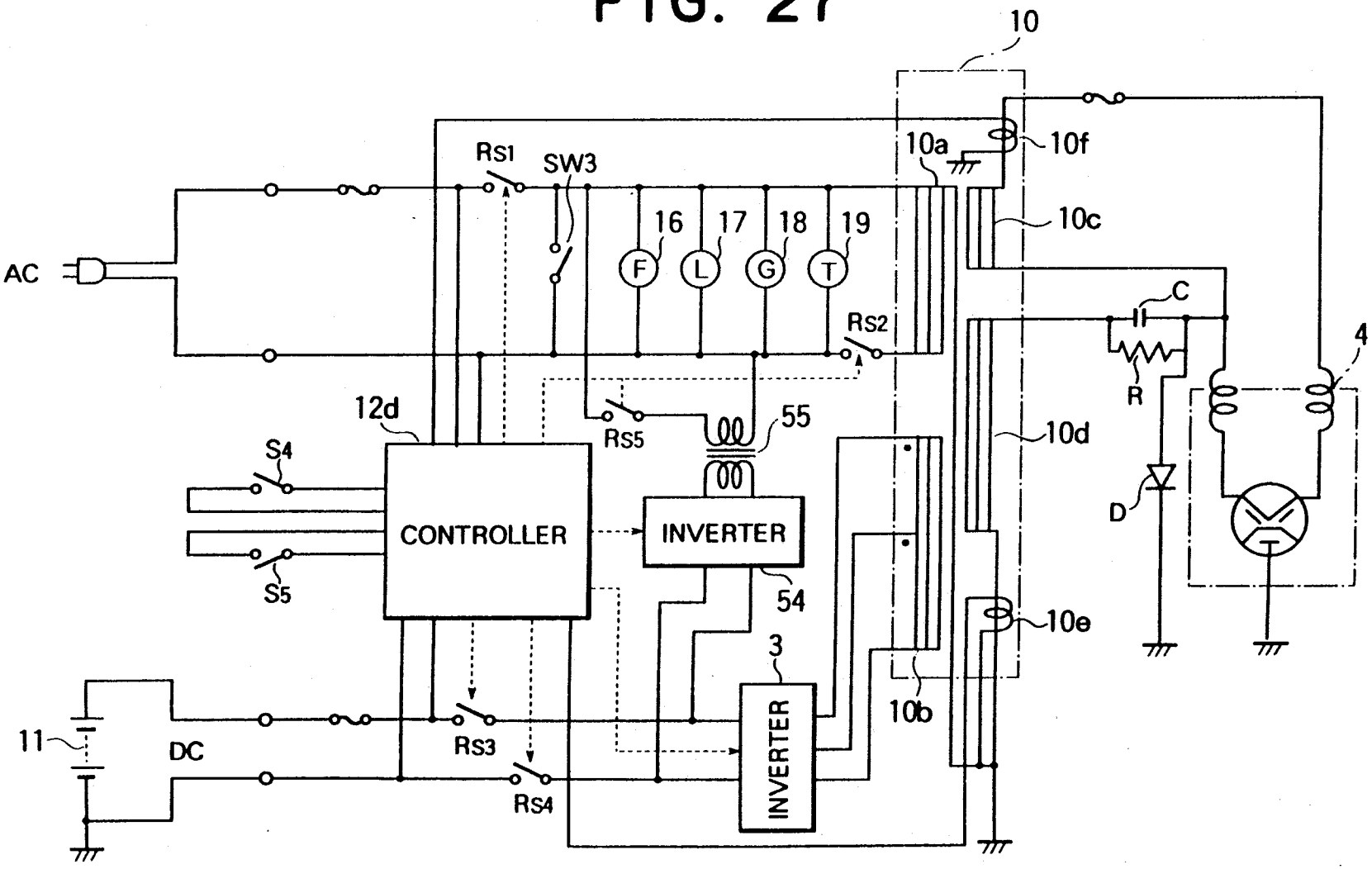
FIG. 27 is an electrical circuit diagram illustrating the eighth embodiment of this invention.

FIG. 27 is an electrical circuit diagram illustrating the eighth embodiment of this invention. Like parts are indicated by like numerals used in the aforementioned embodiments. In FIG. 27, numeral **12*d* refers to a control section; 54 to an inverter; 55** to a transformer; and $Rs_5$ to a relay contact, respectively.

In FIG. 27, when the microwave oven is driven by a-c power source, the a-c voltage is applied to the first primary winding **10*a* of the transformer 10 by closing the contacts $Rs_1$ and $Rs_2$, and opening the contacts $Rs_3$ and $Rs_4$, and the high voltage induced in the second secondary winding 10*d* is double-voltage rectified and fed to drive the magnetron 4. When the microwave oven is driven by d-c power source, the a-c voltage is applied to the second primary winding 10*b* of the transformer 10 via the inverter 3 by opening the contact $Rs_1$ and $Rs_2$ and closing the contacts $Rs_3$ and $Rs_4$, and the high voltage induced in the second secondary winding 10*e* is double-voltage rectified and fed to drive the magnetron 4**.

At this time, the door switches $S_4$ and $S_5$ and the monitor switch $SW_3$ installed on the door are operated in accordance with the opening and closing state of the microwave oven door.

Consequently, when the microwave oven is driven by a-c power source, closing the door causes the control section **12*d* to perform control to close the relay contacts $Rs_1$ and $Rs_2$ in accordance with the operation of the door switches $S_4$ and $S_5$ (at this time, the monitor switch $SW_3$ is kept open), and a-c voltage is applied by the a-c power source to the first primary winding 10*a* of the transformer 10. At this time, the a-c voltage is supplied to the fan motor 16, the turntable motor 18, the timer motor 19 and the indicator lamp 17**, which are installed on the microwave oven.

When the microwave oven is driven by d-c power source using the battery 11, closing the door causes the control section **12*d* to close the relay contacts $Rs_3$, $Rs_4$ and $Rs_5$ in accordance with the operation of the door switches $S_4$ and $S_5$ (at this time, the relay contacts $Rs_1$ and $Rs_2$, and the monitor switch $SW_3$ are kept open), and a-c voltage is applied by the d-c power source to the second primary winding 10*b* of the transformer 10 via the inverter 3. At the same time, an a-c voltage of the same frequency and the same voltage as the a-c power source is generated via the inverter 54 and the transformer 55, and the a-c voltage is applied through the relay contact $Rs_5$ to the fan motor 16, the turntable motor 18, the timer motor 19 and the indicator lamp 17**, which are installed on the side of the a-c power source. That is, even when the microwave oven is driven by d-c power source, the motors installed on the side of the a-c power source can be operated.

Figure 28:
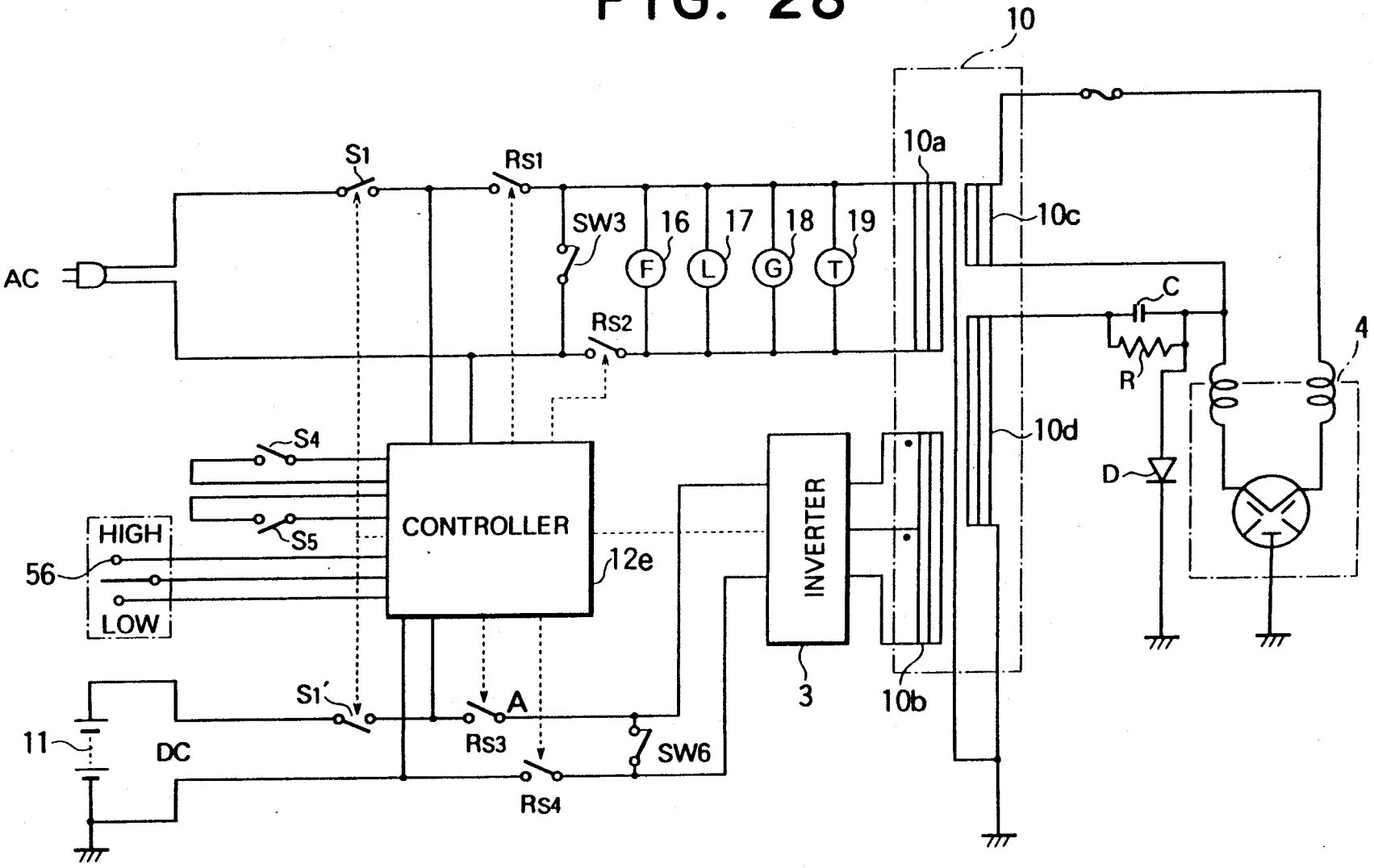
FIG. 28 is an electrical circuit diagram illustrating the ninth embodiment of this invention.

FIG. 28 is an electrical circuit diagram illustrating the ninth embodiment of this invention. Like parts are indicated by like parts used in the aforementioned embodiments.

In FIG. 28, numeral **12*e* refers to a control section; 56 to a setting switch; and $SW_6$ to a monitor switch, respectively. The setting switch 56**, having HIGH and LOW settings, is used for setting the output of the microwave oven from the outside. The monitor switch $SW_6$ corresponds with the monitor switch $SW_3$. Thus, a total of four switches; i.e., the switches $S_4$ and $S_5$, and the monitor switches $SW_3$ and $SW_6$ are installed on the door of the microwave oven.

Figure 29:
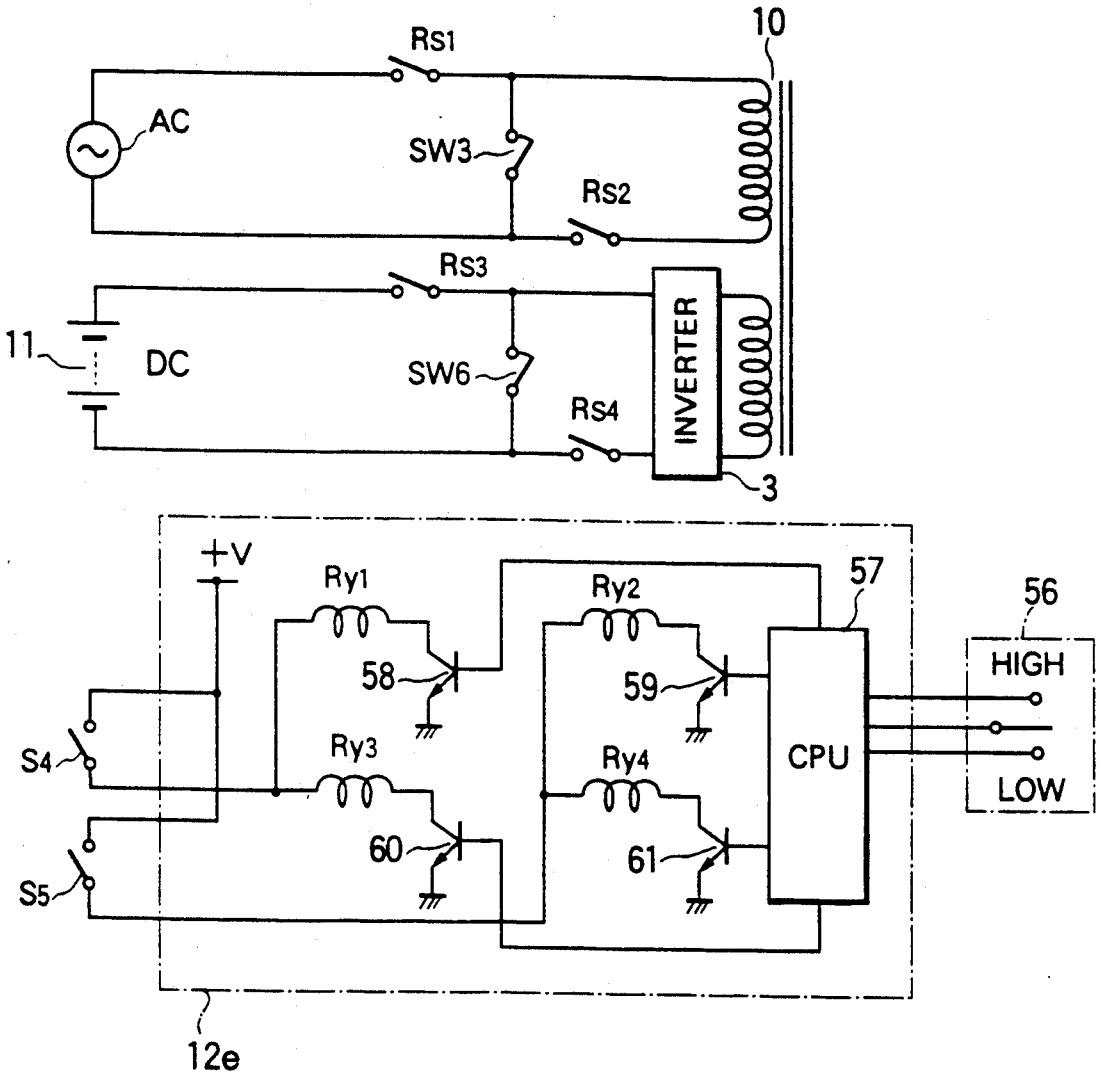
FIG. 29 is an electrical circuit diagram illustrating the essential part of an example of the output changeover device in FIG. 28.

FIG. 29 is an electrical circuit diagram illustrating the essential part of an example of an output changeover device in FIG. 28. Like parts are indicated by like numerals in FIG. 28. In FIG. 29, numeral 57 refers to a CPU; 58 through 61 to transistors; and $Ry_1$ through $Ry_4$ to relays, respectively. The relays $Ry_1$ through $Ry_4$ are adapted to operate the contacts $Rs_1$ through $Rs_4$.

In FIGS. 28 and 29, the control section **12*e* has a circuit, such as a CPU 57, for feeding base current to either of the transistors 58 and 59 or the transistors 60 and 61 in accordance with the type of power, a-c power or d-c power. To the collector side of these transistors 58 through 61** connected are the relays $Ry_1$ through $Ry_4$, and the relays $Ry_1$ and $Ry_3$ are connected to the positive pole side of the d-c voltage via the door switch $S_4$, and the relays $Ry_2$ and $Ry_4$ to the positive pole side of the same d-c voltage via the door switch $S_5$.

The contacts $Rs_1$ and $Rs_2$ of the relays $Ry_1$ and $Ry_2$ are connected to the power line on the side of the a-c power source. This represents the construction corresponding to the switches $SW_1$ and $SW_2$ in FIG. 5.

Similarly, the contacts $Rs_3$ and $Rs_4$ of the relays $Ry_3$ and $Ry_4$ are connected to the power line on the side of the battery 11. This represents the construction corresponding to the switches $SW_3$ and $SW_4$ in FIG. 5.

As the door switches $S_4$ and $S_5$ operate in accordance with the opening and closing of the door, the contacts $Rs_1$ and $Rs_2$ of the relays $Ry_1$ and $Ry_2$, or $Rs_3$ and $Rs_4$ of the relays $Ry_3$ and $Ry_4$ also operate. Since the door switches $S_4$ and $S_5$ may be of a current capacity enough to drive the relays $Ry_1$ through $Ry_4$, small-sized microswitches may serve the purpose. The contacts $Rs_1$ through $Rs_4$ of the relays $Ry_1$ through $Ry_4$ may of a contact capacity in accordance with the capacities of the a-c and d-c power sources, and permits large current to be easily turned on and off.

In FIGS. 28 and 29, the setting switch 56 is adapted to freely set the output of the microwave oven from the outside, and has HIGH and LOW settings.

The CPU 57 in this case sets the timer in accordance with the settings of the setting switch 56.

Now, assuming that the setting switch 56 is set to the HIGH side, the CPU 57 continuously supplies the base current that brings the transistors 58 through 61 into the ON state.

Assuming that the setting switch 56 is set to the LOW side, the CPU 57 supplies the base current that turns on and off the transistors 58 through 61 at a predetermined intervals.

Consequently, as the microwave oven door is closed, the relays $Ry_1$ and $Ry_3$ or $Ry_2$ and $Ry_4$ are energized in accordance with the closing of the door switch $S_4$ or $S_5$, and with the HIGH or LOW setting state of the setting switch 56. That is, when the setting switch 56 is set to the HIGH side, the contacts $Rs_1$ through $Rs_4$ of the relays $Ry_1$ through $Ry_4$ are When the setting switch 56 is set to the LOW side, the contacts $Rs_1$ through $Rs_4$ of the relays $Ry_1$ through $Ry_4$ are alternately closed and opened at a predetermined interval. With this, power feeding to the magnetron is controlled and the output of the microwave oven is changed over for each type of power source.

This invention having the aforementioned construction and operation can accomplish the following effects.

(1) By applying a frequency higher than the frequency of the commercial power source to the primary winding of the transformer, a single transformer can have secondary windings for a-c and d-c power sources. This helps reduce the size and weight of the microwave oven. In addition, the voltage peak value applied to the magnetron can be made equal for either of a-c or d-c power source. When the microwave oven is driven by d-c power, a constant voltage can be fed to the magnetron.

(2) Merely by modifying the high-voltage transformer for producing the supply voltage to the magnetron, the space for installing the transformer can be reduced. This leads to the reduced size and weight of the microwave oven, and to reduced cost. With a simple means for monitoring battery terminal voltage and detecting battery temperature, the battery can be prevented from overdischarging.

(3) When the microwave oven is powered with two power sources, the door construction can be simplified while adopting the same switch configuration as that of the prior art. If an abnormality occurs in the relay contacts on the side of d-c power source, the warning lamp lights up and the operation of the microwave oven is discontinued, and microwave oven is positively prevented from leaking. Monitor switches to be installed on the door can be eliminated.

(4) With a transformer having a first primary winding to be driven by a-c power, a second primary winding to be driven by d-c power via an inverter, and a secondary winding, leakage characteristics can be provided between the first primary winding and the secondary winding.

(5) Since battery voltage is detected under no load when power is fed to the microwave oven, battery voltage can be detected irrespectively of not only voltage drop due to load but also voltage drop due to lead wires. Since the difference between no-load voltage and on-load voltage can be detected during the operation of the inverter, the internal resistance of the battery can be detected under both no-load and on-load conditions. Consequently, when the microwave oven is driven by battery power source, the battery can be more positively prevented from overdischarging.

(6) By installing motors on the side of the a-c power source, motors on the side of the d-c power source can be eliminated. This leads to the reduced number of components and the reduced size of the microwave oven. As the output frequency of the inverter may be any desired frequency, any oscillating frequency can be used, in designing the microwave oven, in accordance with the capacity of the microwave oven. This leads to an efficient microwave oven. Since the induced voltage in the transformer can be cut off by using switches as safety devices (such as $Rs_2$ and $Rs_4$), only a small number of switches is required.

(7) Without the use of a special timer switch TS, the contacts of the relays as safety devices are used so that the relay contacts operate in accordance with the set output state of the microwave oven. This leads to simplified circuits.

What is claimed is:

1. A microwave oven operatable on either AC or DC power sources, the oven comprises:

a transformer having a primary side and a secondary side, said primary side having a first primary winding and a second primary winding, said secondary side having a first secondary winding and a second secondary winding, said first primary winding being connectable to the AC power source;

a magnetron receiving heater current from said first secondary winding and receiving load current from said second secondary winding;

invertor means for transforming power from the DC power source into inverter AC power, said invertor means delivering said inverter AC power to said second primary winding;

frequency control means for increasing a frequency of said invertor AC power to a frequency larger than a frequency of the AC power source in order to compensate for a change in voltage in said secondary winding due to different power characteristics between said AC power source and said invertor AC power;

current sensor means for sensing current in said second secondary winding;

frequency control means for controlling said frequency of said invertor AC power in accordance with said current sense by said current sensor means;

phase control means for adjusting phase characteristics of said invertor AC power in accordance with said current sensor means;

input voltage phase means for adjusting said duty cycle of said invertor AC power in accordance with a voltage of the DC power source.

2. A microwave oven in accordance with claim 1, further comprising:

battery voltage monitor means for monitoring said voltage of the DC power source and for interrupting the DC power source of the invertor means when said voltage of the DC power source is below a predetermined value.

3. A microwave oven in accordance with claim 1, further comprising:

battery temperature monitor means for monitoring a temperature of the DC power source and for interrupting the DC power source of said invertor means when said temperature of the DC power source exceeds a predetermined value.

4. A microwave oven in accordance with claim 1, wherein:

said transformer has bypass path means for passing magnetic flux between said first primary winding and said secondary windings.

5. A microwave oven in accordance with claim 1, further comprising:

a shunt resistor connected between the DC power source and said invertor means;

zero-cross sensor means for sensing a zero-crossing of current flowing through said shunt resistor;

no-load voltage measuring means for measuring said voltage of the DC source when said zero-cross sensor means senses a zero-crossing, and for determining if an over-discharged state of the DC source exists.

6. A microwave oven in accordance with claim 5, further comprising:

on-load voltage sensor means for measuring said voltage of the DC source during operation of said invertor means, said on-load voltage sensor means determining a difference between the said voltage of the DC source measured by said on-load voltage sensor means and measured by said no-load voltage measuring means, said difference being used to determine internal resistance of the DC source.

* * * * *